US011530087B2

(12) United States Patent
LiVigni et al.

(10) Patent No.: US 11,530,087 B2
(45) Date of Patent: Dec. 20, 2022

(54) PACK OF ELECTRICALLY HEATED CIGARETTES

(71) Applicant: G.D SOCIETA' PER AZIONI, Bologna (IT)

(72) Inventors: Angelo LiVigni, Bologna (IT); Alver Tacchi, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 1066 days.

(21) Appl. No.: 16/301,550

(22) PCT Filed: May 19, 2017

(86) PCT No.: PCT/IB2017/052966
§ 371 (c)(1),
(2) Date: Nov. 14, 2018

(87) PCT Pub. No.: WO2017/199214
PCT Pub. Date: Nov. 23, 2017

(65) Prior Publication Data

US 2019/0177077 A1 Jun. 13, 2019

(30) Foreign Application Priority Data

May 20, 2016 (IT) ..... 102016000052379
Jun. 1, 2016 (IT) ..... 102016000056603

(51) Int. Cl.
*B65D 85/10* (2006.01)
*A24F 15/01* (2020.01)
*A24F 15/18* (2006.01)

(52) U.S. Cl.
CPC ..... *B65D 85/1045* (2013.01); *A24F 15/01* (2020.01); *A24F 15/18* (2013.01); *B65D 85/1081* (2013.01); *B65D 2209/00* (2013.01)

(58) Field of Classification Search
CPC ..... A24F 15/01; A24F 15/18; B65D 85/10; B65D 85/1045; B65D 85/1081; B65D 2209/00
See application file for complete search history.

(56) References Cited

U.S. PATENT DOCUMENTS 2,811,247 A 10/1957 Stevenson
5,480,025 A 1/1996 Draucker et al.
(Continued)

FOREIGN PATENT DOCUMENTS

CA 2724107 A1 * 12/2009 ..... B65D 85/1054
CN 201750711 U * 2/2011 ..... A24F 15/18
(Continued)

OTHER PUBLICATIONS

European Patent Application No. 1773675838, Communication Pursuant to Article 9493) EPC, dated Dec. 12, 2019.
(Continued)

*Primary Examiner* — Bryon P Gehman
(74) *Attorney, Agent, or Firm* — Marshall, Gerstein & Borun LLP

(57) ABSTRACT

The invention relates to a pack of electrically heated cigarettes, which comprises a container and a lid hinged one another; wherein the container comprises a top chamber which houses a group of cigarettes, a bottom chamber and a dividing wall, which divides the top chamber from the bottom chamber; and wherein a drawer is provided, which is arranged in the area of the bottom chamber and can slide between a closed position, in which the drawer is completely arranged inside the container and an open position, limited by a limit stop device, in which the drawer is partially pulled out of the container; the distance between the dividing wall and the top wall of the lid when the latter closes the top opening of the container, being between 4.5 and 5.5 centimetres; and the distance between the bottom wall of the
(Continued)

drawer, when the latter is in the relative closed position, and the dividing wall being between 3.5 centimetres and 4.5 centimetres.

15 Claims, 18 Drawing Sheets

(56) References Cited

U.S. PATENT DOCUMENTS

| | | | |
|---|---|---|---|
| 5,996,588 | A | 12/1999 | Abrines Amer et al. |
| 2013/0140201 | A1 | 6/2013 | Ghini et al. |

FOREIGN PATENT DOCUMENTS

| | | | |
|---|---|---|---|
| EM | 2580134-61 | | 3/2014 |
| EP | 2325093 | A1 | 5/2011 |
| EP | 2366637 | A1 | 9/2011 |
| FR | 2495444 | A1 | 6/1982 |
| GB | 513798 | A | 10/1939 |
| GB | 1036133 | A | 7/1966 |
| JP | H9215488 | A | 8/1997 |
| JP | 3150442 | U | 5/2009 |
| JP | 2011251766 | A | 12/2011 |
| JP | 2013511441 | A | 4/2013 |
| JP | 2013531589 | A | 8/2013 |
| JP | 2015535515 | A | 12/2015 |
| KR | 2014-0032859 | A | 3/2014 |
| WO | WO-2014/082717 | A1 | 6/2014 |
| WO | WO-2014/087082 | A1 | 6/2014 |
| WO | WO-2016/166692 | A1 | 10/2016 |

OTHER PUBLICATIONS

Office Action, Japanese patent application No. 2018-560781, dated Mar. 23, 2021.

International Application No. PCT/IB2017/052966, International Search Report and Written Opinion, dated Aug. 24, 2017.

International Application No. PCT/IB2017/052966, International Preliminary Reporton Patentability, dated Apr. 17, 2018.

Office Action, Korean patent application No. 10-2018-7035602, dated Aug. 11, 2021.

* cited by examiner

PACK OF ELECTRICALLY HEATED CIGARETTES

CROSS-REFERENCE TO RELATED APPLICATIONS

This is U.S. national phase of International Application No. PCT/IB2017/052966, filed May 19, 2017, which claims the benefit of Italian Patent Application No. 102016000052379, filed May 20, 2016 and Italian Patent Application No. 102016000056603, filed Jun. 1, 2016.

TECHNICAL FIELD

The present invention relates to a pack of electrically heated cigarettes.

PRIOR ART

Electrically heated cigarettes have recently been introduced on the market, which consist of a cylinder made of actual tobacco which is not subjected to direct combustion (namely it is not burned, i.e. "lighted-up" by means of a flame) as is the case with traditional cigarettes, but is heated by means of an electrical resistor so as to generate an aerosol that is inhaled by the smoker (thus without generating neither smoke nor ash). Accordingly, for smoking a cigarette to be electrically heated, an electronic device with electrical resistor is used and an end of the cigarette is inserted.

The electrically heated cigarettes have a cylindrical shape, they have approximately the diameter of a traditional cigarette and have a length (longitudinal development) considerably reduced (about half) with respect to a traditional cigarette; consequently, for packaging electrically heated cigarettes packs has been proposed, having a height approximately halved with respect to traditional packs.

This significant dimensional difference has shown negative repercussions from the point of view of consumer perception, in that the height of these packs is very different from the height of the traditional packs, to which smokers have been accustomed for decades.

On the other hand, a simple solution to overcome the disadvantage described above could be provided by making a traditional pack but having a double bottom for dividing a top chamber, containing electrically heated cigarettes, and an empty bottom chamber.

Another equally simple solution could be provided by making a pack with the height of a traditional pack but having a filler element arranged at the bottom of the pack.

However, both of these solutions may be perceived by the smoker as an utterly useless bulk of the pack.

Patent Application GB1036133A and Patent Application FR2495444A1 describe a rigid pack of cigarettes comprising: a group of cigarettes; a container whose inner volume is divided into a top chamber that houses the group of tobacco articles and in a bottom chamber which remains available; a lid which is hinged to the container; and a drawer which is arranged in the bottom chamber and is mounted in a sliding manner in the container between a closed position, in which the drawer is completely arranged inside the container, and an open position, in which the drawer is partially pulled out of the container, projects outwards from the container and is accessible from the outside.

DESCRIPTION OF THE INVENTION

The object of the present invention is to provide a pack of electrically heated cigarettes which solves the above described drawbacks and is, at the same time, easy and inexpensive to implement.

Another object of the present invention is to provide a pack of electrically heated cigarettes which has a more practical design and convenient use.

According to the present invention, these objects are achieved by providing a pack of electrically heated cigarettes according to the appended claims.

In particular, according to the present invention a pack of electrically heated cigarettes is proposed, comprising:

a group of electrically heated cigarettes;

a container, which houses the group of electrically heated cigarettes and comprises a top opening, a front wall, a rear wall opposite the front wall, and two side walls opposite to one another; and a lid, which comprises a top wall, a front wall, a rear wall opposite the front wall and connected, in particular hinged, to the rear wall of the container, and two side walls opposite to one another;

wherein the container comprises a top chamber, which houses the group of electrically heated cigarettes, a bottom chamber and a dividing wall which divides the top chamber from the bottom chamber;

wherein the pack of electrically heated cigarettes is characterized by further comprising:

a drawer which is arranged in the area of the bottom chamber and can slide between a closed position in which the drawer is completely arranged inside the container and an open position in which the drawer is partially pulled out of the container projects outwards from the container itself and is accessible from the outside; and a limit stop device which fulfils the function of stopping the outward movement of the drawer from the container, namely of preventing the drawer from being completely pulled out of the container, thus establishing a maximum limit for the outward movement of the drawer from the container;

wherein the drawer comprises a bottom wall, a front wall, a rear wall opposite the front wall and two side walls opposite to one another;

and in that, the distance between the dividing wall and the top wall of the lid, when the latter closes the top opening of the container, is comprised between 4.5 and 5.5 centimetres; and the distance between the bottom wall of the drawer, when the latter in its closed position, and the dividing wall is comprised between 3.5 centimetres and 4.5 centimetres.

Preferably, the distance between the side walls of the container is comprised between 5.0 centimetres and 5.7 centimetres.

Preferably, in addition, the distance between the front wall and the rear wall of the container is comprised between 1.8 centimetres and 2.3 centimetres.

In this way, on the one hand, from the point of view of consumer perception, the size, in particular the height, of the pack containing the electrically heated cigarettes are essentially the same as those of traditional packs to which smokers have been accustomed for decades, on the other hand, the drawer and its chamber (bottom) are perfectly sized to add to the pack the useful and profitable functionality of collecting waste consisting in used cigarettes.

Furthermore advantageously, the top chamber is divided into two semi-chambers side by side, each housing a corresponding semi-group of electrically heated cigarettes.

In this way, it is avoided that, as a result of the consumption of electrically heated cigarettes, and therefore the reduction of their number within the pack, the few residual cigarettes may intersect and become jammed within the pack itself.

Advantageously, each semi-group of cigarettes is enclosed in a wrap, in particular a sealed wrap, which has an extraction mouth that can be opened and closed by means of a label; and wherein said label is fixed to the wrap by means of a repositionable adhesive, which is arranged around the extraction mouth to allow the label to be partially separated from the wrap several times for opening the extraction mouth and then fixed again to the wrap for closing the extraction mouth.

In this way, due to the combination of the split of the wrap in two semi-wraps, to the sealing and the reclosing of the latter by means of respective adhesive labels, the freshness of the electrically heated cigarettes is preserved, which, if exposed for a long time to the environment, tend to dry out and do not generate an optimal amount of aerosol.

BRIEF DESCRIPTION OF THE DRAWINGS

The present invention will now be described with reference to the accompanying drawings, which illustrate some examples of non-limiting embodiments, wherein.

PREFERRED EMBODIMENTS OF THE INVENTION

Figure 2:
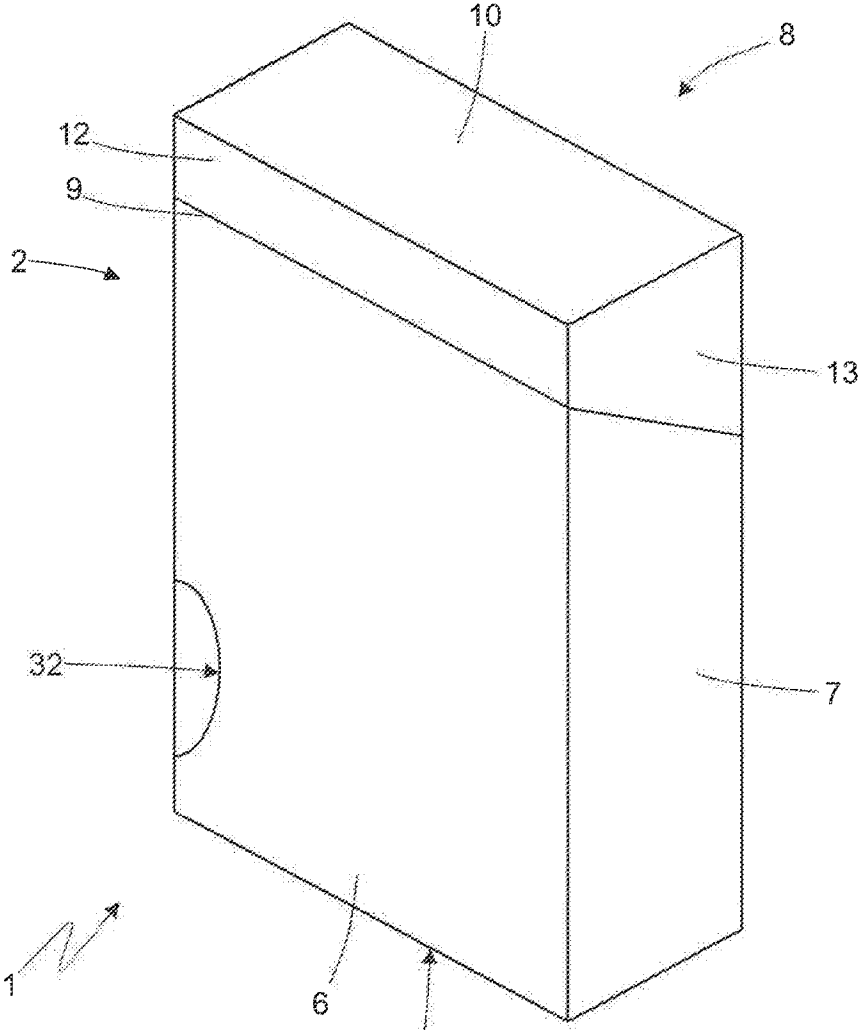
FIG. 2 is a rear perspective view of the pack of electrically heated cigarettes of FIG. 1 in a closed configuration.
Figure 1:
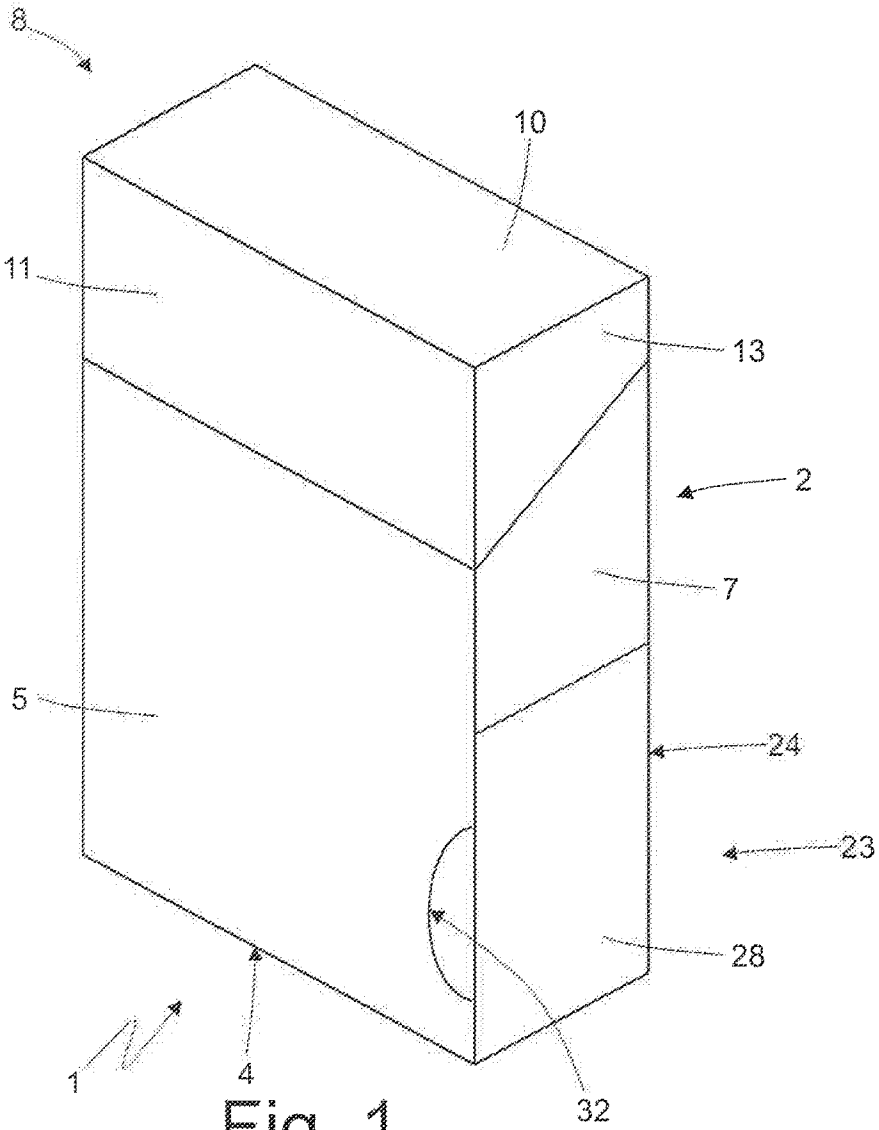
FIG. 1 is a front perspective view of a pack of electrically heated cigarettes which is made according to the present invention and is in a closed configuration.
Figure 3:
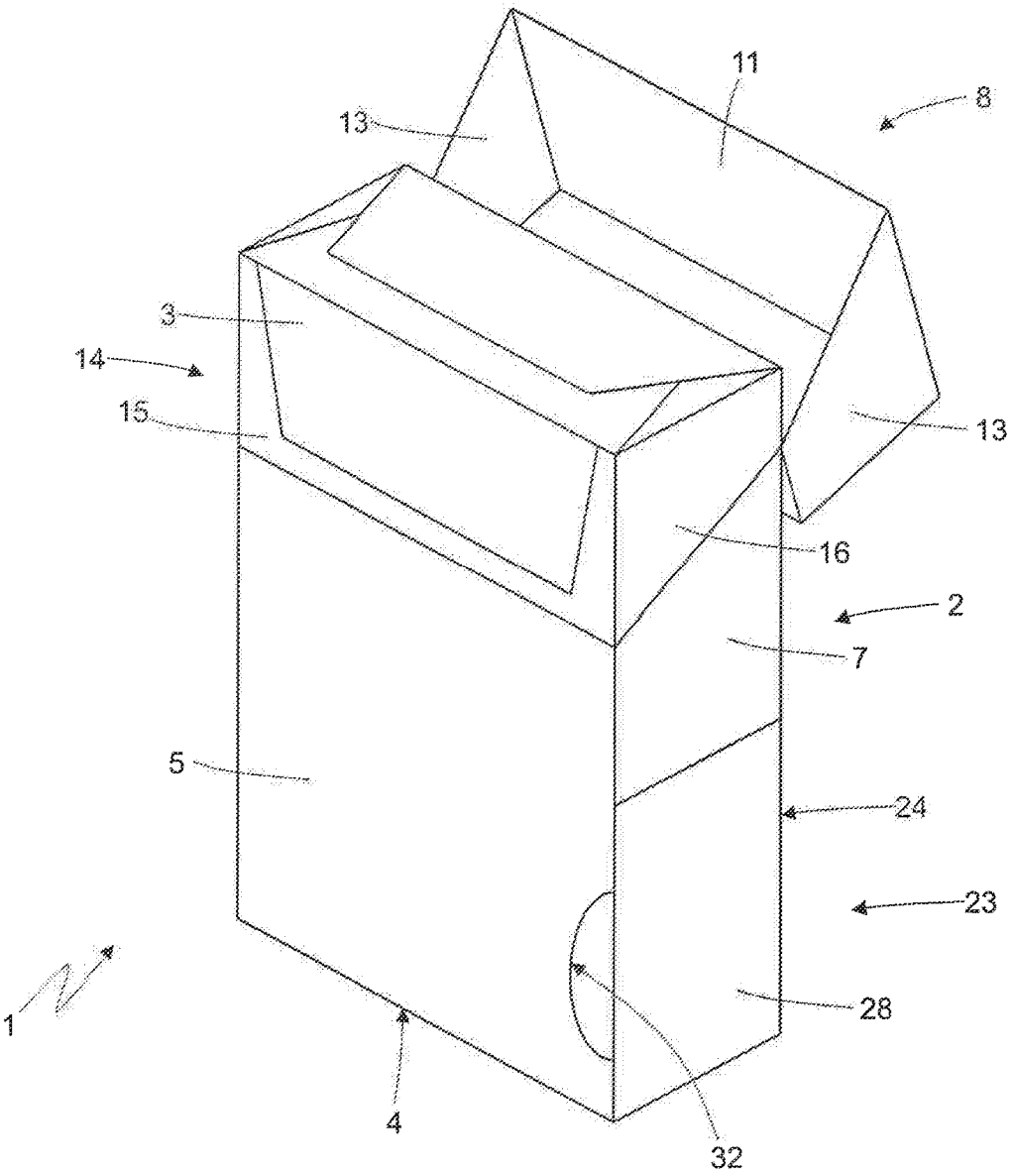
FIG. 3 is a front perspective view of the pack of electrically heated cigarettes of FIG. 1 in a configuration open from the top.

In FIGS. 1, 2 and 3, number 1 denotes as a whole a pack of electrically heated cigarettes (the latter not illustrated).

The electrically heated cigarettes consist of a cylinder made of actual tobacco which is not subjected to direct combustion (namely it is not burned, i.e. "lighted-up" by means of a flame) as is the case with traditional cigarettes, but is instead heated by means of an electrical resistor so as to generate an aerosol that is inhaled by the smoker (thus without generating neither smoke nor ash). Consequently, for smoking a cigarette to be electrically heated, an electronic device with an electrical resistor is used and an end of the cigarette is inserted.

The pack 1 of electrically heated cigarettes is made of cardboard or paperboard, has a parallelepiped shape and comprises a cup-shaped container 2 and a wrap 3 (partially visible in FIG. 3) housed inside the container 2.

The container 2 is cup-shaped and has: a top opening, a bottom wall 4 opposite the top opening, a front wall 5, a rear wall 6 opposite the front wall 5, and two side walls 7 opposite to one another. Between the walls 5, 6 and 7, four longitudinal edges are defined, whereas four transverse edges are defined between the walls 4, 5, 6 and 7.

The container 2 is provided with a rigid lid 8 which is hinged to the container 2 along a hinge 9 (arranged in the area of the rear wall 6 of the container 2 and visible in FIG. 2) and is mobile between a closed position (illustrated in FIGS. 1 and 2) in which the lid 8 covers the top opening of the container 2 and an open position (illustrated in FIG. 3) in which the lid 8 leaves free access to the top opening of the container 2. The lid 8 is cup-shaped and has: a bottom opening, a top wall 10 opposite the bottom opening, a front wall 11, a rear wall 12 opposite the front wall 11 and connected to the rear wall 6 of the container 2 by means of the hinge 9, and two side walls 13 opposite to one another. Four longitudinal edges are defined between the walls 11, 12 and 13, whereas four transverse edges are defined between the walls 10, 11, 12 and 13.

The wrap 3 encloses a group of electrically heated cigarettes (not illustrated) and is formed by a wrap of metalized sheet folded around the group of electrically heated cigarettes. According to a different embodiment, the wrap 3 is of a sealed type and has at the top and at the front, a pull-out opening closed by a reusable sealing label (namely internally provided with a repositionable adhesive that does not dry); a connection tab of the closing label can be glued to the front wall 11 of lid 8 so that the closing label is "automatically" opened and closed by exploiting the movement of the lid 8. According to a further embodiment, instead of a single wrap 3, two twin and side by side wraps 3 are provided, namely the single wrap 3 is divided into two twin, side by side and half-sized wraps 3.

As illustrated in FIG. 3, the pack 1 of electrically heated cigarettes further comprises a rigid collar 14 (namely made of rigid cardboard or paperboard), which is connected (by gluing) folded in a "U"-shape inside the container 2 to partially project outwards from the top open end and engage a corresponding inner surface of the lid 8 when the lid 8 itself is arranged in the closed position. The collar 14 comprises a front wall 15 which is connected (preferably glued) to the front wall 5 of the container 2 and in contact with the front wall 11 of the lid 8 when the lid 8 is in the closed position and two side walls 16 opposite to one another, which are connected (preferably glued) to the side walls 7 of the container 2 and are in contact with the side walls 13 of the lid 8 when the lid 8 is in the closed position. According to a preferred embodiment illustrated in the attached figures, the front wall 15 of the collar 14 has a "U"-shaped recess to facilitate the extraction of the electrically heated cigarettes. According to a preferred embodiment, the front wall 15 of the collar 14 is provided with a pair of claw-shaped elements laterally projecting to engage the side walls 16 of the lid 8 when the lid 8 is in the closed position so as to keep the lid 8 in the closed position (alternatively, the front wall 15 of the collar 14 may be free of the claw-shaped elements).

If the wrap 3 is of a sealed type, the wrap 3 itself can comprise a rigid reinforcement element in the inside thereof; in this case, the collar 14 can still be present or can also be absent.

Figure 4:
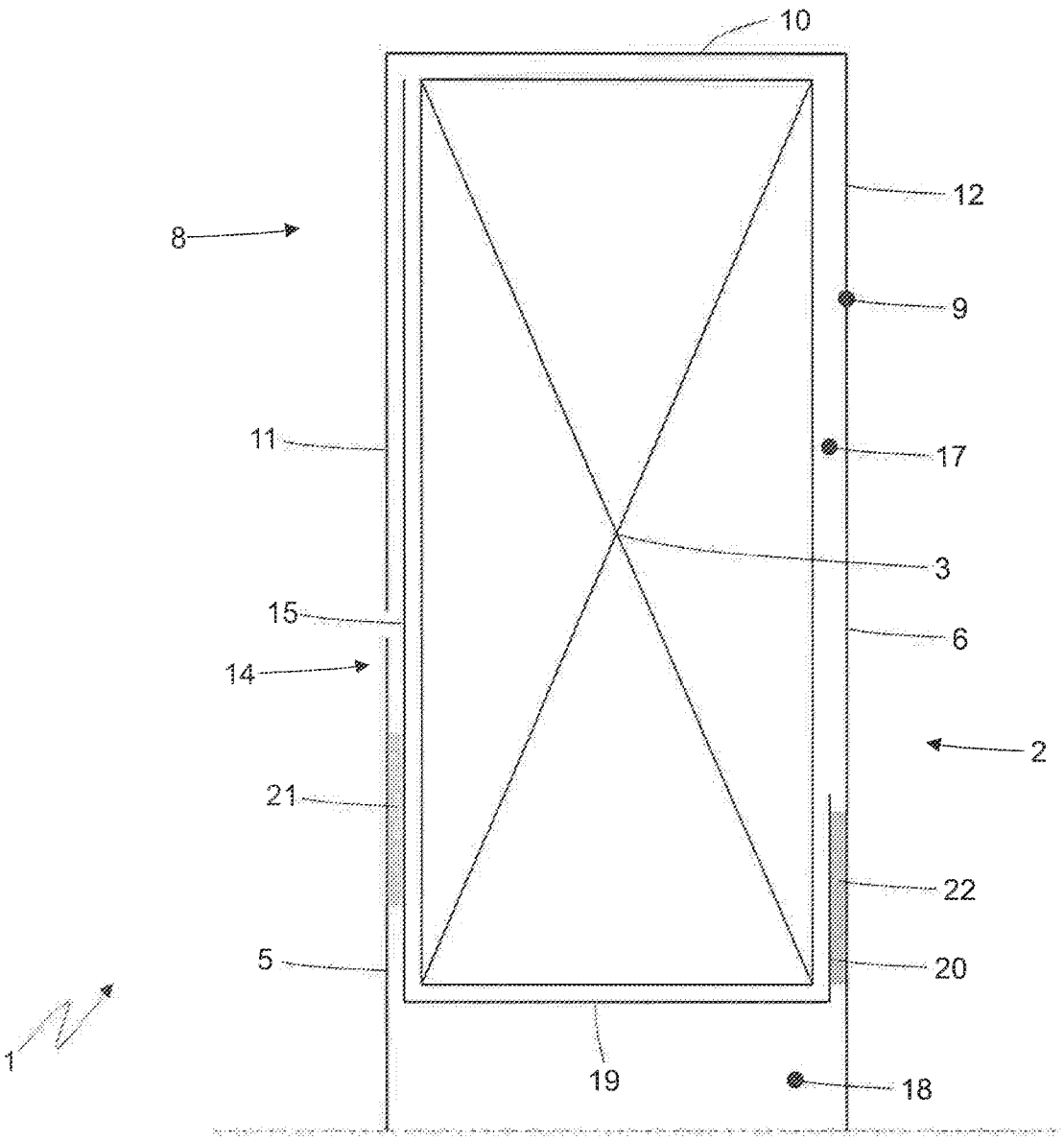
FIG. 4 is a schematic and in longitudinal section view of a top portion of the pack of electrically heated cigarettes of FIG. 1.

As illustrated in FIG. 4, the inner volume of the container 2 is divided into a top chamber 17 (fully visible in FIG. 4) which houses the wrap 3 and a bottom chamber 18 (partially visible in FIG. 4) which is available and can, therefore, be used (as described below) to house an accessory or to house the electrically heated cigarettes that are already used and therefore exhausted (it is important to note that electrically heated cigarettes are not consumed as they do not burn but are exhausted when their aromatic content ends). As is well known, electrically heated cigarettes have a cylindrical shape, they have approximately the diameter of a traditional cigarette and have a length (longitudinal development) considerably reduced (about half the size) with respect to a traditional cigarette; consequently, the wrap 3 has the same transverse cross-section as a traditional wrap and has a height approximately halved with respect to a traditional wrap.

According to a preferred embodiment illustrated in FIG. 4, a dividing wall 19 is provided, which is parallel to the bottom wall 4 of the container 2 and to the top wall 10 of the lid 8, and divides the top chamber 17 from the bottom chamber 18 (namely divides the inner volume of the container 2 in the top chamber and in the bottom chamber 18). According to a preferred embodiment illustrated in FIG. 4, the dividing wall 19 is part of the collar 14, namely, is connected to the front wall 15 of the collar 14 along a transverse folding line and is folded by 90° relative to the front wall 15 of the collar 14. According to a preferred embodiment illustrated in FIG. 4, the dividing wall 19 is provided with a connection tab 20 which is connected to the dividing wall 19 along a transverse folding line, is folded by 90° relative to the dividing wall 19, and rests against and is glued to the rear wall 6 of the container 2. As illustrated in FIG. 4, the front wall 15 of the collar 14 rests against the front wall 5 of the container 2 and is glued to the front wall 5 of the container 2 by means of a glue 21; furthermore, the connection tab 20 rests against the rear wall 6 of the container 2 and is glued to the rear of the container 2 by means of a glue 22.

Figure 5:
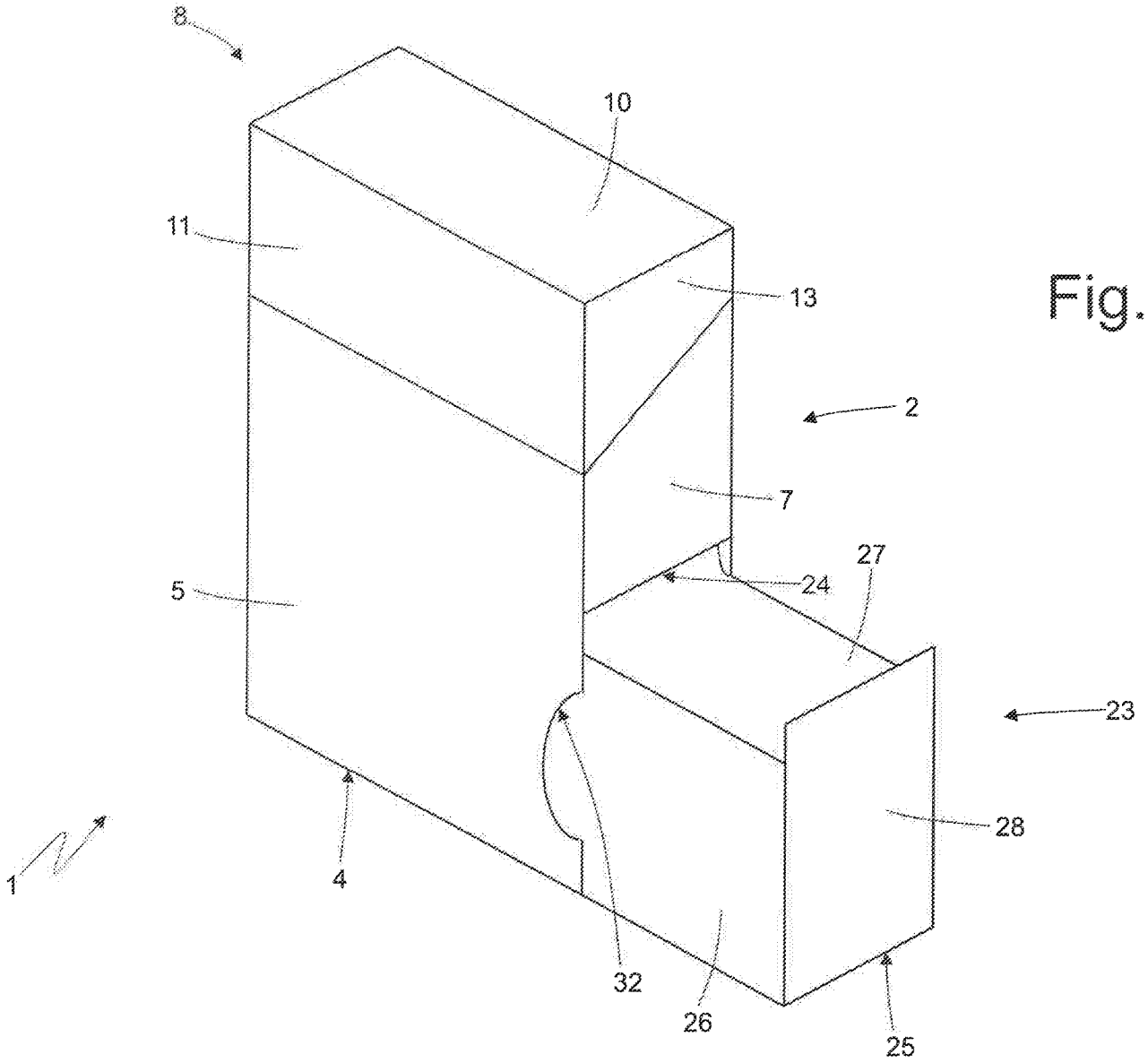
FIG. 5 is a front perspective view of the pack of electrically heated cigarettes of FIG. 1 in a configuration open at the bottom.

As illustrated in FIG. 5, the pack 1 of electrically heated cigarettes further comprises a drawer 23 which is arranged in the area of the bottom chamber 18 (namely, below the wrap 3) can slide (has a sliding opening) by means of linear movement between a closed position (illustrated in FIGS. 1, 2 and 3) in which the drawer 23 is completely arranged inside the container 2 (namely, inside the bottom chamber 18 of the container 2) and an open position (illustrated in FIG. 5) in which the drawer 23 is partially pulled out of the container 2 and projects outwards from the container 2, and is accessible from the outside. In other words, the container 2 houses the drawer 23 in a sliding manner so as to allow the drawer 23 itself to slide relative to the container 2 in order to move with a linear movement between a closed position (illustrated in FIGS. 1, 2 and 3), in which the drawer 23 is completely inserted inside the container 2 and an open position (illustrated in FIG. 2), in which the drawer 23 is partially pulled out of the container 2 so as to allow direct access, by a user, to the drawer 23. According to an alternative embodiment not illustrated, the drawer 23 has a sliding opening by means of a rotatable movement between the closed position and the open position.

In order to allow the movement of the drawer 23 between the open position and the closed position, a wall of the container 2 has a pull-out opening 24 through which the drawer 23 is moved. In the embodiment illustrated in FIGS. 1-5, the drawer 23 moves transversely (namely, with a moving direction that is parallel to the bottom wall 4 of the container 2 and to the top wall 10 of the lid 8 and perpendicular to the side walls 7 of the container 2 and to the side walls 13 of the lid 8), and therefore the pull-out opening 24 for the drawer 23 is formed through a side wall 7 of the container 2.

As illustrated in FIG. 5, the drawer 23 is parallelepiped-shaped and has: a bottom wall 25 parallel to and facing the bottom wall 4 of the container 2, a front wall 26 parallel to the front wall 5 of the container 2, a rear wall 27 parallel to and facing the rear wall 6 of the container 2, and two side walls 28 (only one of which is illustrated in FIG. 5) parallel to the side walls 7 of the container 2. In particular, in the closed position (illustrated in FIGS. 1, 2 and 3) a side wall 28 of the drawer 23 (not shown in FIGS. 1, 2 and 3) faces a corresponding side wall 7 of the container 2 whereas the other side wall 28 of the drawer 23 (illustrated in FIGS. 1 and 3) is coplanar to the corresponding side wall 7 of the container 2, is arranged in the area of the pull-out opening 24 and closes the pull-out opening 24 itself.

Figure 6:
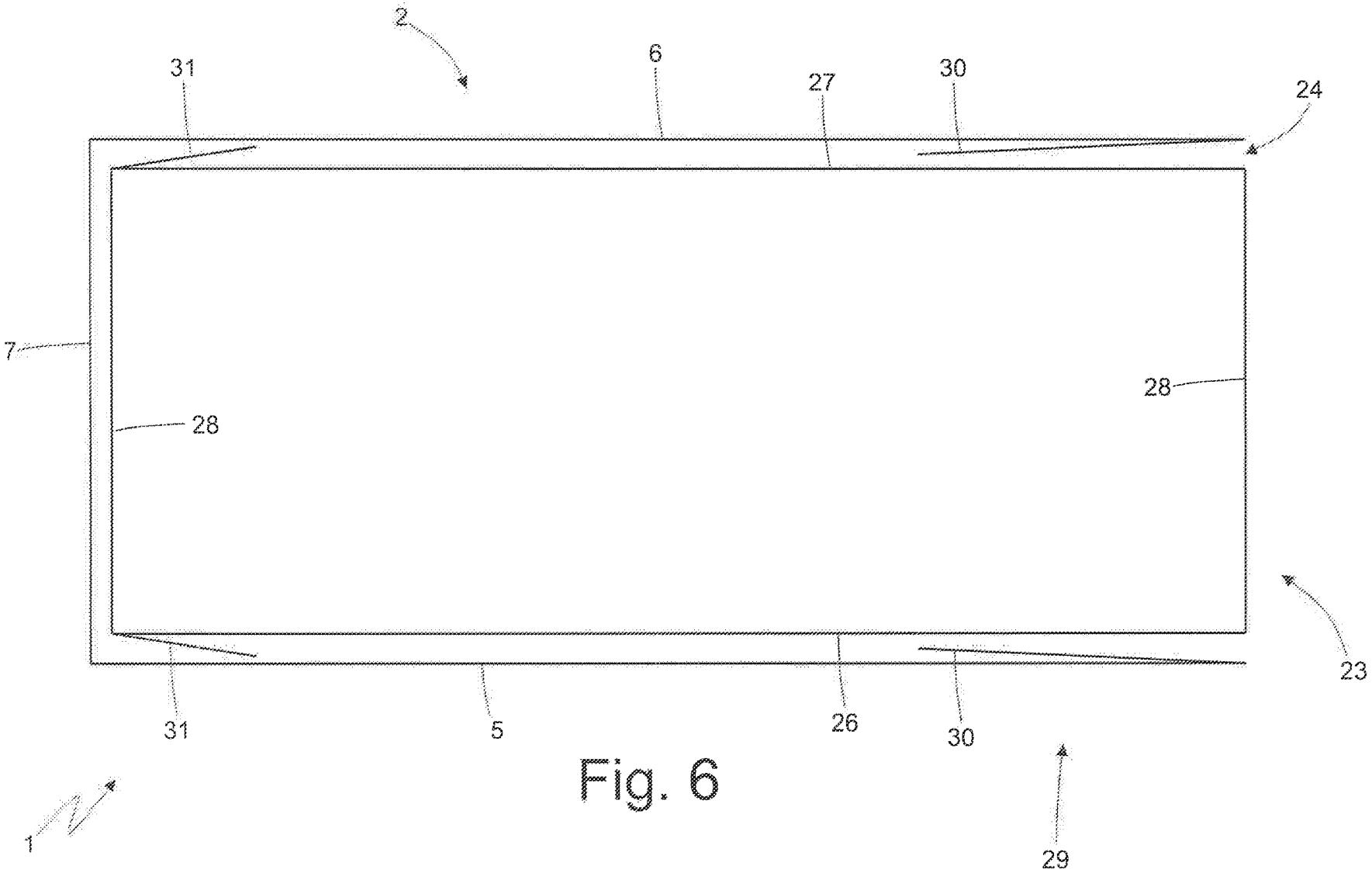
FIG. 6 is a schematic and in cross-section view of a bottom portion of the pack of electrically heated cigarettes of FIG. 1.

As illustrated in FIG. 6, a limit stop device 29 is provided, which fulfils the function of stopping the outward movement of the drawer 23 from the container 2 in a maximum open position, namely of preventing the drawer 23 from being completely pulled out of the container 2 by setting a maximum limit for the pull-out movement of the drawer 23 from the container 2. The limit stop device 29 comprises two stopping tabs 30, each of which is connected to a side wall 7 of the container 2 in the area of an edge of a pull-out opening 24 and projects from the side wall 7 towards the inside of the container 2. In addition, the limit stop device 29 comprises two stopping tabs 31, each of which is arranged in proximity to the side wall 28 of the drawer 23 opposite the pull-out opening 24 and projects towards the outside of the drawer 23 starting from the edge connecting the front wall 26 or the rear wall 27 to the side wall 28 itself. According to a preferred embodiment (illustrated in FIG. 9), the front wall 26 and the rear wall 27 of the drawer 23 carry the corresponding stopping tabs 31 that are cut-out from them. In use, namely during the final part of the pull-out movement of the drawer 23, each stopping tab 31 engages (namely couples, is inserted inside) the corresponding stopping tab 30 causing the stop of the pull-out movement of the drawer 23 (namely preventing the drawer 23 from being completely pulled out of the container 2).

According to a preferred embodiment illustrated in FIGS. 1, 2, 3 and 5, the front wall 5 and the rear wall 6 of the container 2 comprise respective claw-shaped holding recesses 32, which allow a user to get hold of the underlying walls 26 and 27 of the drawer 23 and then pull out the drawer 23 towards the outside, to move the drawer 23 from the closed position to the open position.

According to a possible and non-limiting embodiment (which can be added or modified in respect to the presence of the holding recess 32), the side wall 7 of the container 2 opposite the pull-out opening 24 has a hole, which has such form and dimensions so as to allow the user, through the side wall 7 itself, to exert a force on the corresponding side wall 28 of the drawer 23 so as to allow the drawer 23 itself to slide towards its open position.

Figure 7:
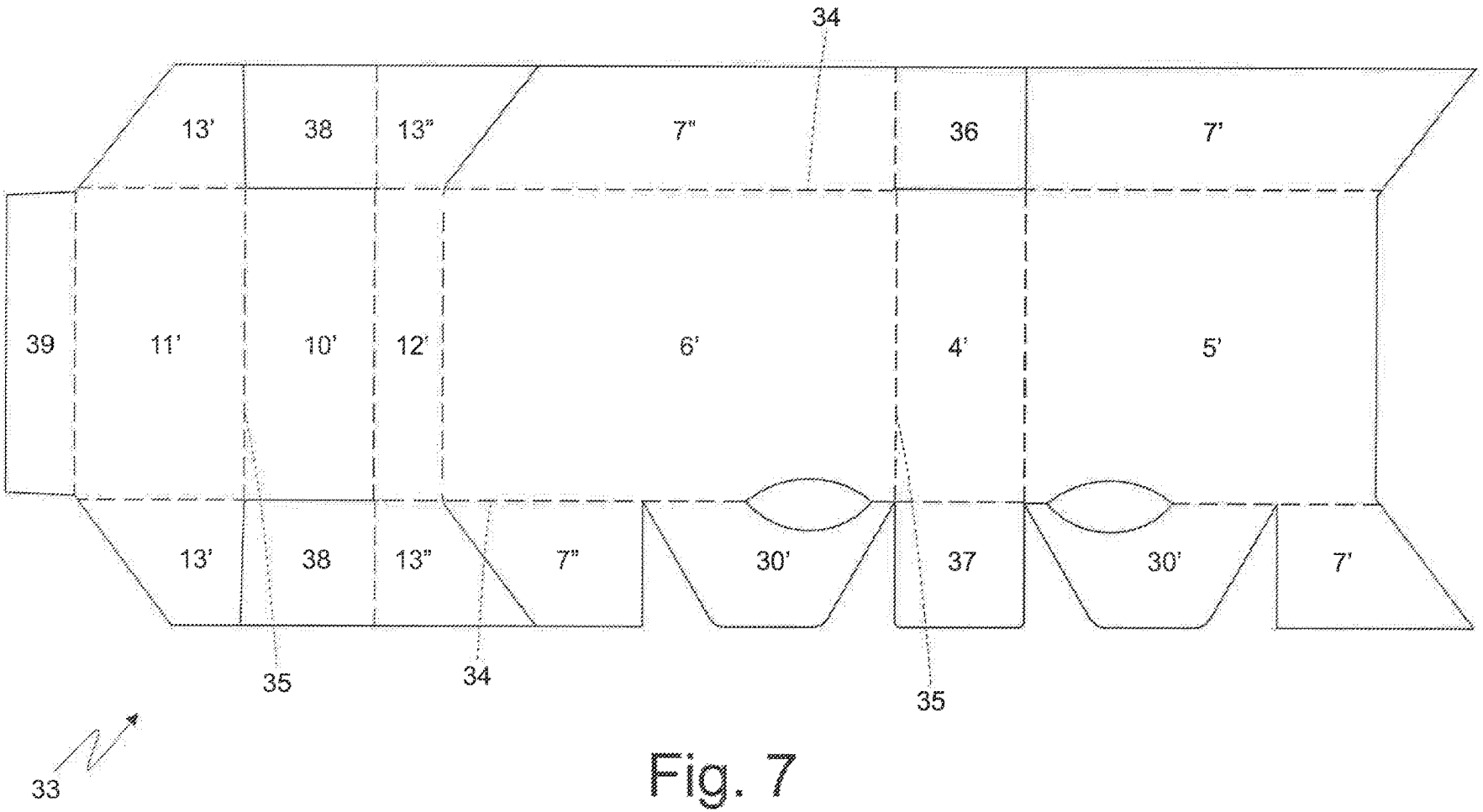
FIG. 7 is a plan view of a blank used to make a container and a lid of the pack of electrically heated cigarettes of FIG. 1.

As illustrated in FIG. 7, the container 2 and the lid 8 are obtained starting from a flat blank 33 having a substantially rectangular elongated shape. The blank 33 has two longitudinal folding lines 34 and a plurality of transverse folding lines 35, which define, between the two longitudinal folding lines 34, a panel 11' making up the front wall 11 of the lid 8, a panel 10' making up the top wall 10 of the lid 8, a panel 12' making up the rear wall 12 of the lid 8, a panel 6' making up the rear wall 6 of the container 2, a panel 4' making up the bottom wall 4 of the container 2 and a panel 5' making up the front wall 5 of the container 2. The transverse folding line 35, which divides the panels 12' and 6' makes up the hinge 9 of the lid 8.

The panel 5' has two wings 7', which are arranged on opposite sides of the panel 5', are connected to the panel 5' by means of the longitudinal folding lines 34 and make up the outer parts of the two side walls 7 of the container 2. The panel 6' has two wings 7", which are arranged on opposite sides of the panel 6', are connected to the panel 6' by means of the longitudinal folding lines 34 and make up the inner parts of the two side walls 7 of the container 2. The panel 11' has two wings 13', which are arranged on opposite sides of panel 11', are connected to panel 11' by means of the longitudinal folding lines 34 and make up the outer parts of two side walls 13 of lid 8. The panel 12' has two wings 13", which are arranged on opposite sides of the panel 12', are connected to panel 12' by means of the longitudinal folding lines 34 and make up the inner parts of the two side walls 13 of the lid 8.

The panel 5' also comprises an additional wing 30', which is arranged beside a corresponding wing 7", is connected to the panel 5' along a longitudinal folding line 34 and makes up a stopping tab 30 of the limit stop device 29. Likewise, the panel 6' also comprises an additional wing 30', which is arranged beside a corresponding wing 7', is connected to the panel 6' along a longitudinal folding line 34 and makes up a stopping tab 30 of the limit stop device 29.

A wing 7" has a tab 36 which is connected to the wing 7" by means of a transverse folding line 35 and is folded by 90° to be glued to an inner surface of the panel 4'. The panel 4' comprises a tab 37 which is connected to the panel 4' by means of a longitudinal folding line 34 and is folded by 180° against the panel 4' to be glued to an inner surface of the panel 4'.

Each wing 13" has a tab 38 which is connected to the wing 13" by means of a transverse folding line 35 and is folded by 90° to be glued to an inner surface of the panel 10'.

Finally, the panel 11' has a flap 39 which is connected to the panel 11' by means of a transverse folding line 35 and is folded by 180° against the panel 11' to be glued to an inner surface of the panel 11' itself.

Figure 8:
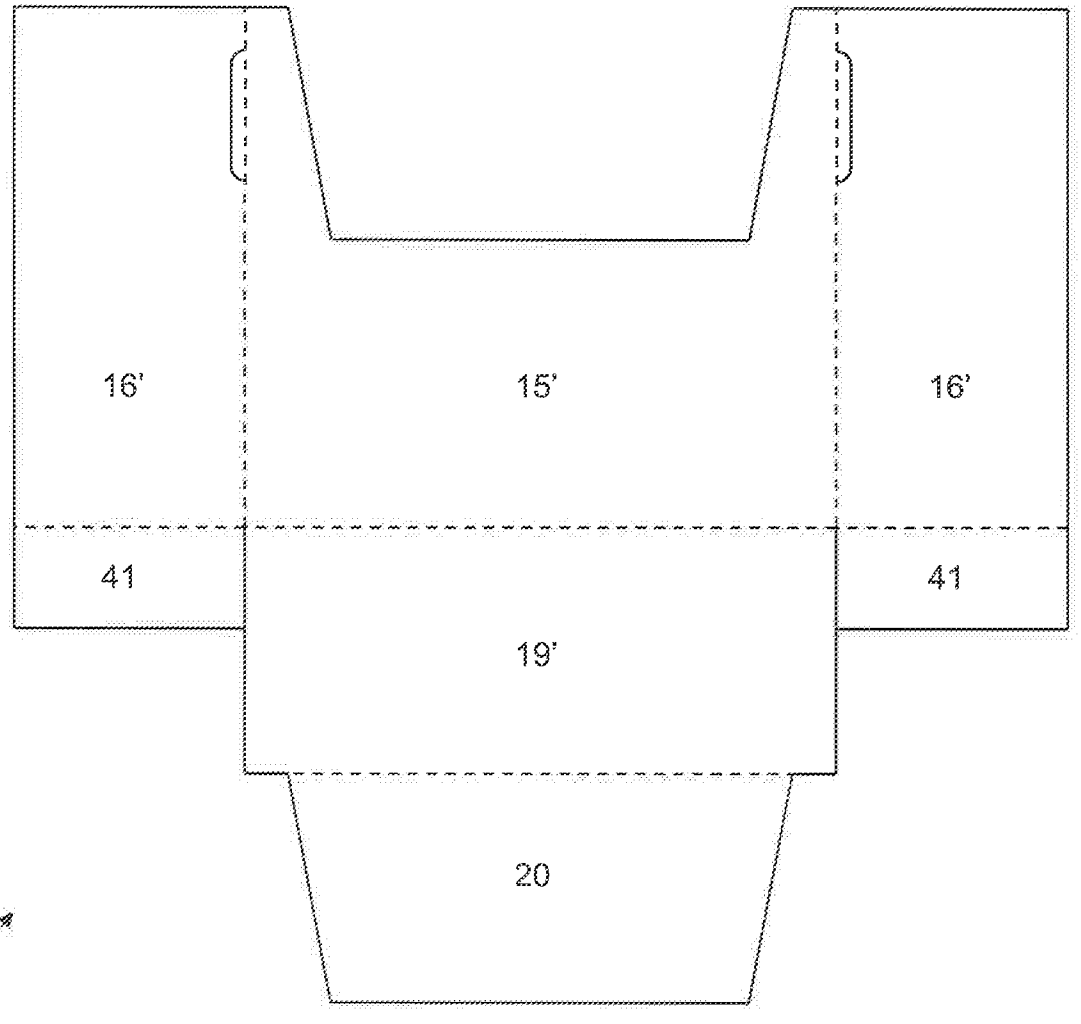
FIG. 8 is a plan view of a blank used to make a collar of the pack of electrically heated cigarettes of FIG. 1.

As illustrated in FIG. 8, the collar 14 is obtained starting from a blank 40 having: a panel 15' making up the front wall 15 of the collar 14, a panel 19' making up the dividing wall 19 of the collar 14, and a panel 20' making up the connection tab 20 of the collar 14. Two wings 16' are connected to the panel 15' which make up the side walls 16 of the collar 14. Each wing 16' has a tab 41 which is folded by 90° to be glued to an inner surface of the panel 19'.

Figure 9:
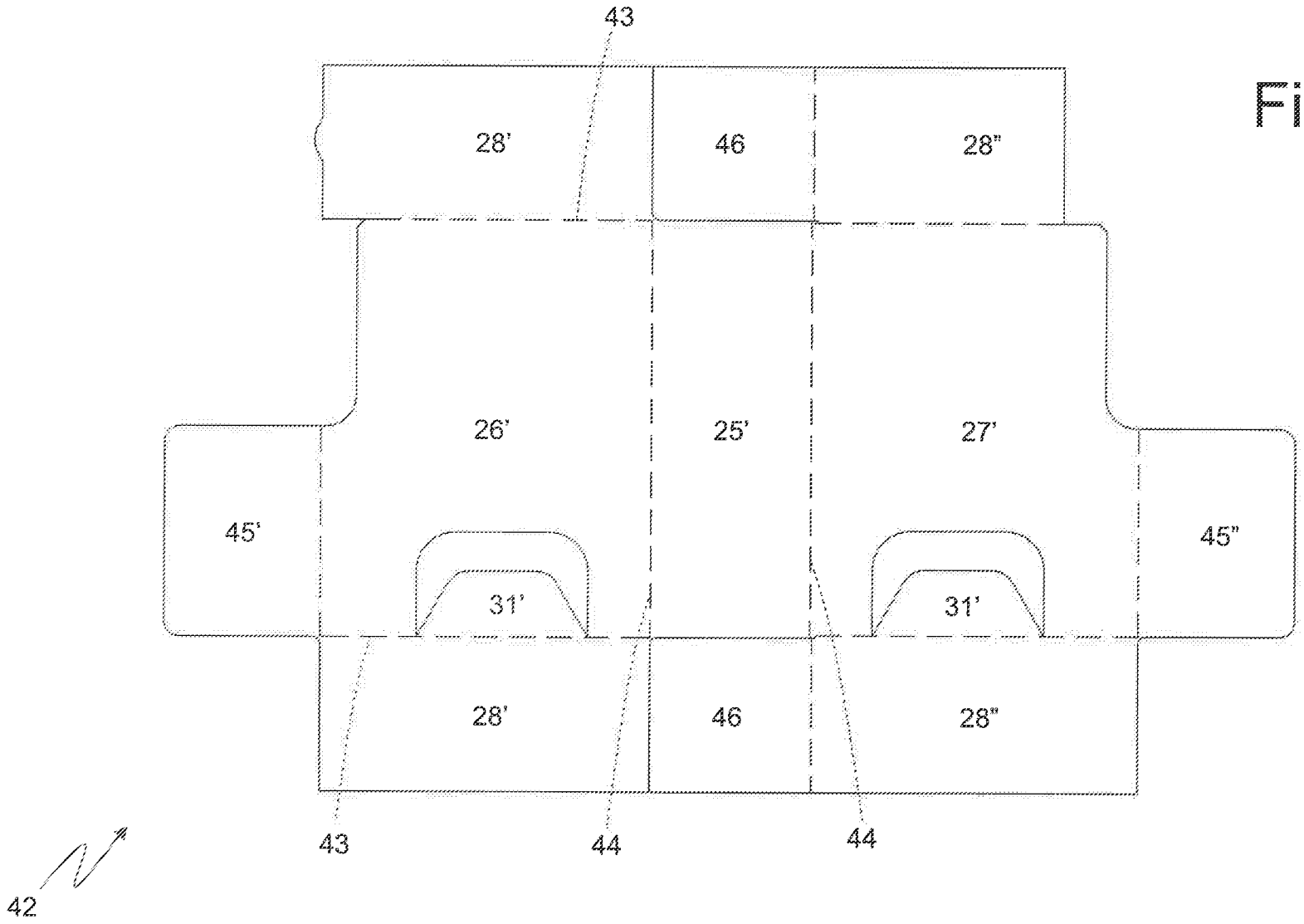
FIG. 9 is a plan view of a blank used to make a drawer of the pack of electrically heated cigarettes of FIG. 1.

As illustrated in FIG. 9, the drawer 23 is obtained starting from a flat blank 42 having a substantially rectangular shape. The blank 42 has two longitudinal folding lines 43 and a plurality of transverse folding lines 44, which define, between the two longitudinal folding lines 43, a panel 45' making up an outer part of a top wall of the drawer 23 (not illustrated), a panel 26' making up the front wall 26 of the drawer 23, a panel 25' making up the bottom wall 25 of the drawer 23, a panel 27' making up the rear wall 27 of the drawer 23, and a panel 45" making up an inner part of the top wall of the drawer 23.

The panel 26' has two wings 28', which are arranged on opposite sides of the panel 26', are connected to the panel 26' by means of the longitudinal folding lines 43 and make up the outer parts of the two side walls 28 of the drawer 23. The panel 27' has two wings 28", which are arranged on opposite sides of the panel 27', are connected to the panel 27' by means of the longitudinal folding lines 43 and make up the inner parts of the two side walls 28 of the drawer 23.

Each wing 28" has a tab 46, which is connected to the wing 28" by means of a transverse folding line 44 and is folded by 90° to be glued to an inner surface of the panel 25'.

Passing through windows are provided inside the panels 26' and 27', in which appendages 31' are obtained, which make up the stopping tabs 31'.

In the embodiment illustrated in FIGS. 1-5, the drawer 23 can comprise a top wall (visible only in the panels 45' and 45" of the blank 42 illustrated in FIG. 9), which must have a limited extension so as to allow access from the top inside the drawer 23. According to alternative embodiments, the drawer 23 is without a top wall.

Figure 10:
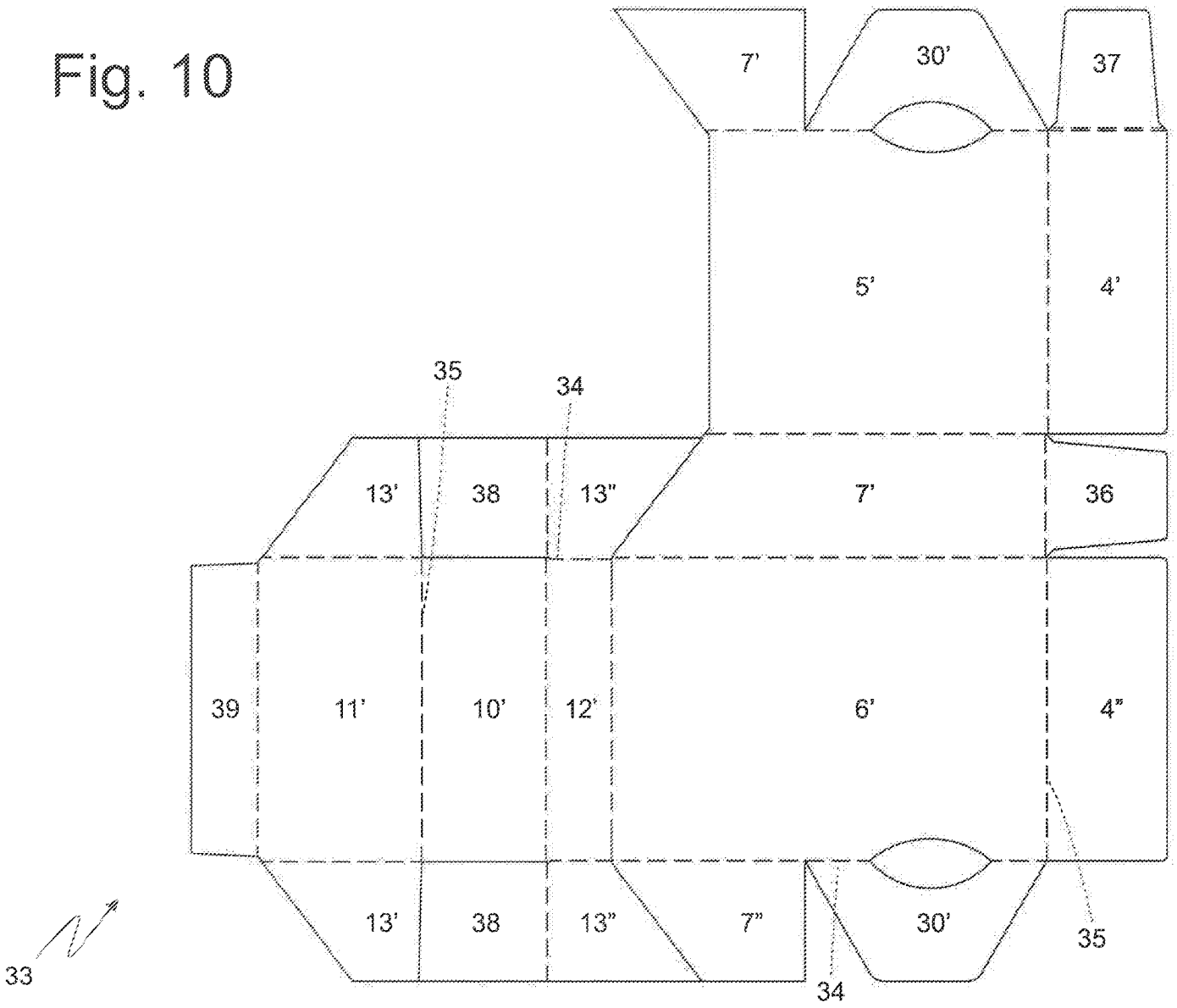
FIG. 10 is a plan view of an alternative of the blank of FIG. 7.

In FIG. 10 an alternative of the blank 33, illustrated in FIG. 7, for making the container 2 and lid 8 is illustrated. The blank 33 illustrated in FIG. 10 has a "L" shape in which the wing 7' is connected on one side to the panel 6', which makes up the rear wall 6 of the container 2 along a longitudinal folding line 34 and is connected on the other side to the panel 5', which makes up the front wall 5 of the container 2 along a further longitudinal folding line 34. In addition, the blank 33 illustrated in FIG. 10 has two different panels 4' and 4" which are respectively connected to the panels 5' and 6' by means of a transverse folding line 35 and are superimposed one on the other to form the bottom wall 4 of the container 2. Finally, in the blank 33 illustrated in FIG. 10, the tab 36 is connected to the wing 7' and is folded by 90° relative to the wing 7' to be glued to an inner surface of the panel 4".

In the embodiment illustrated in FIGS. 1-5, the drawer 23 moves transversely (namely, with a moving direction that is parallel to the bottom wall 4 of the container 2 and to the top wall 10 of the lid 8 and perpendicular to the side walls 7 of the container 2 and to the side walls 13 of the lid 8), and therefore the pull-out opening 24 for the drawer 23 is formed through a side wall 7 of the container 2.

In the alternative embodiment illustrated in FIGS. 11, 12, 13 and 13*a*, the drawer 23 moves longitudinally (namely, with a moving direction that is perpendicular to the top wall 10 of the lid 8 and parallel to the side walls 7 of the container 2 and to the side walls 13 of the lid 8), and therefore the pull-out opening 24 for the drawer 23 is formed through the bottom wall 4 of the container 2 and preferably completely replaces the bottom wall 4 of the container 2 (namely the bottom wall 4 of the container 2 is no longer present and is completely replaced by the pull-out opening 24).

Figure 13:
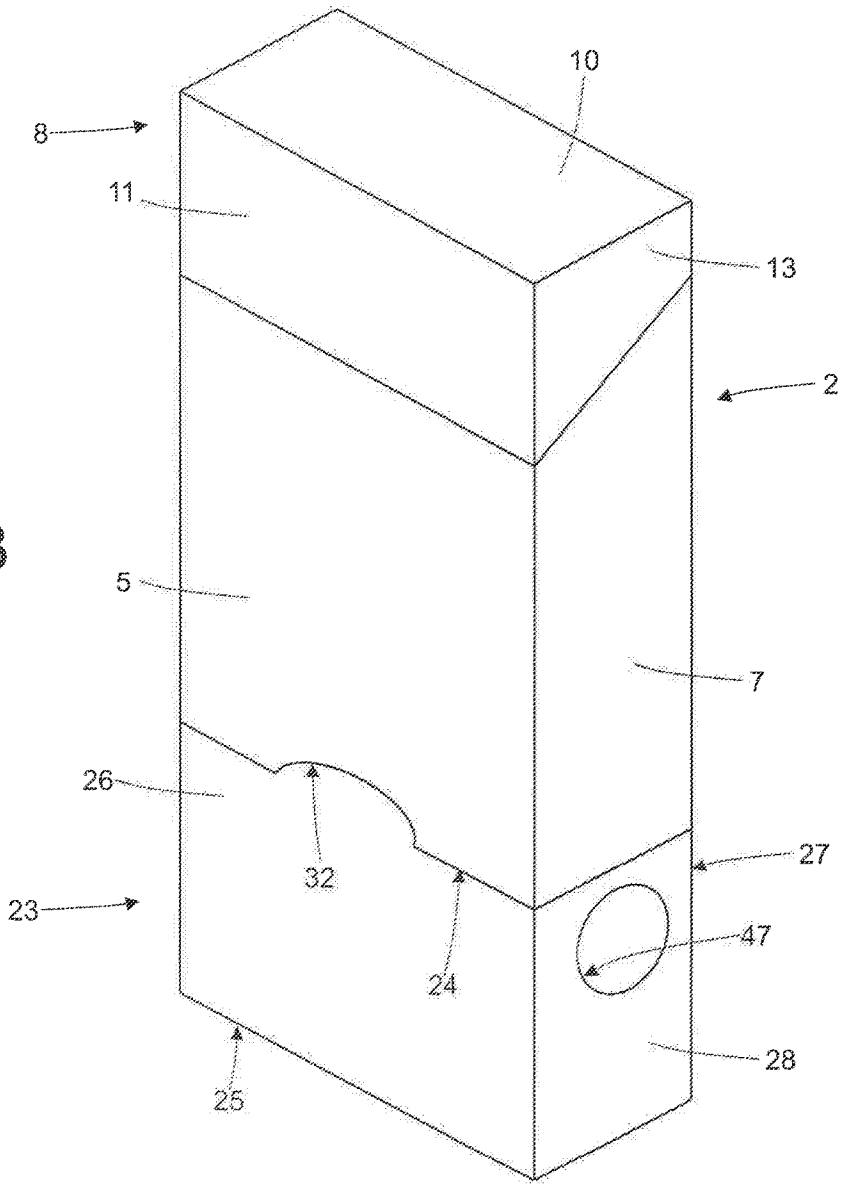
FIG. 13 is a front perspective view of the pack of electrically heated cigarettes of FIG. 11 in a configuration open at the bottom.
Figure 13A:
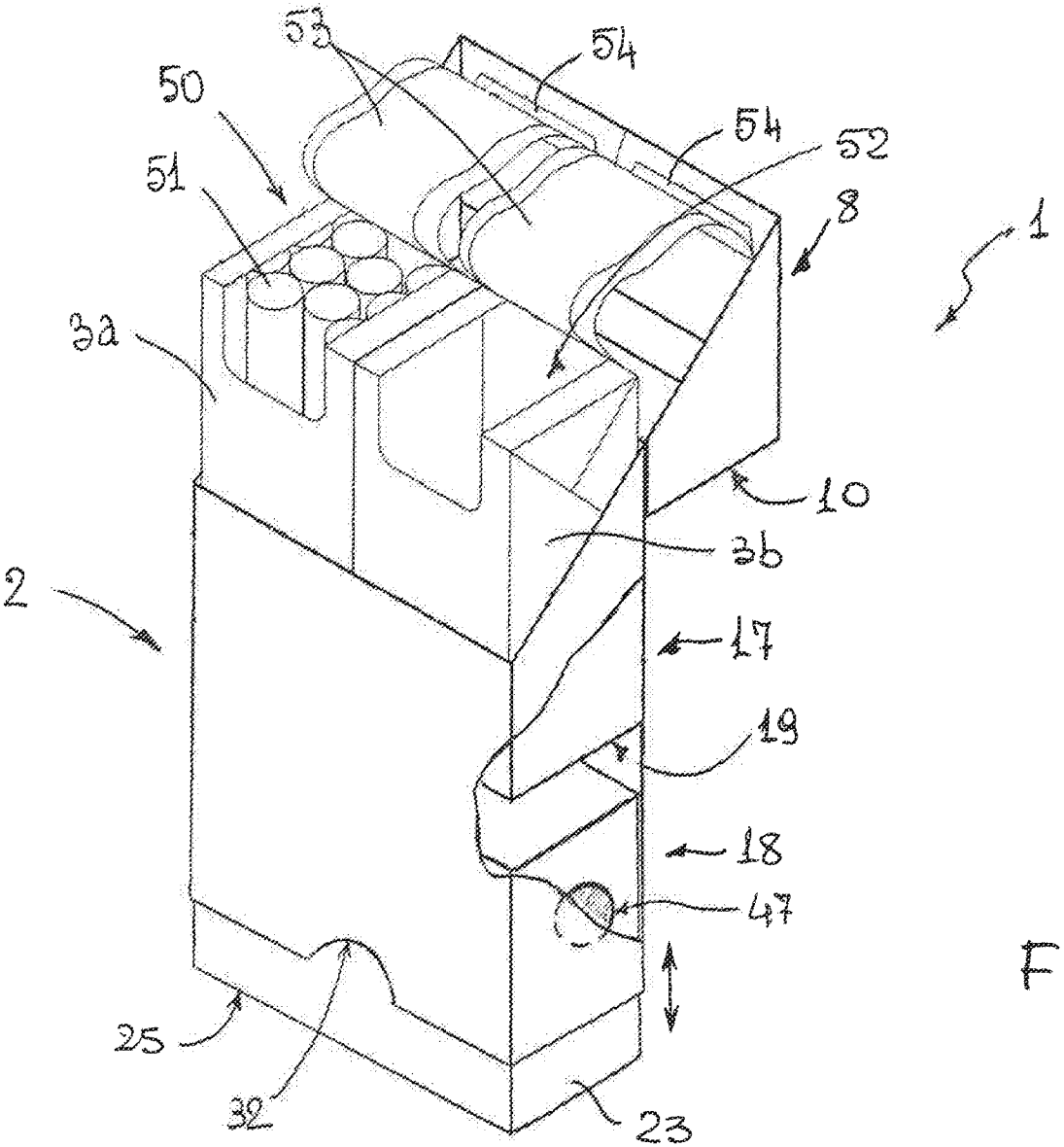
FIG. 13*a* is a further front perspective view of the pack of electrically heated cigarettes of FIG. 11 in a configuration open at the top and partially open at the bottom.

As illustrated in FIG. 13*a*, the top chamber 17 is divided into two semi-chambers side by side each other, each housing a respective semi-group of electrically heated cigarettes 51. The two semi-groups define the group 50 of cigarettes 51 contained in pack 1.

Each of the semi-group of cigarettes 51 is enclosed by a respective wrap 3*a*, 3*b*.

Preferably, each wrap 3*a*, 3*b* is of a sealed type, namely substantially hermetically welded in the area of the said closing end portions 3*a*, 3*b*.

Each wrap 3*a*, 3*b* has an extraction mouth 52 which can be opened and closed by means of a label 53.

The label 53 is fixed to the wrap 3*a*, 3*b* by means of a repositionable adhesive, which is arranged around the extraction mouth 52 to allow label 53 to be repeatedly partially separated from the wrap 3*a*, 3*b* so as to open the extraction mouth 52 and then be fixed again to the wrap 3*a*, 3*b* to close the extraction mouth 52.

A tab 54 of the label 53 may be glued to the front wall 11 of lid 8 (as illustrated in FIG. 13*a*) so that the label 53 is "automatically" opened and closed by exploiting the movement of the lid 8

Alternatively, both tabs 54, or only one of the tabs 54, may be left free to be gripped by the fingers of the smoker. According to a further embodiment, instead of the two wraps 3*a*, 3*b*, a single wrap may be provided, preferably sealed and optionally provided with a reusable closing label, which may or may not be fixed to lid 8.

It is important to note that in the area of the top chamber 17 the pack 1 of electrically heated cigarettes illustrated in FIGS. 11, 12, 13, 13*a* can alternatively be entirely identical to the pack 1 of electrically heated cigarettes illustrated in FIGS. 1-5, and vice versa.

Figure 12:
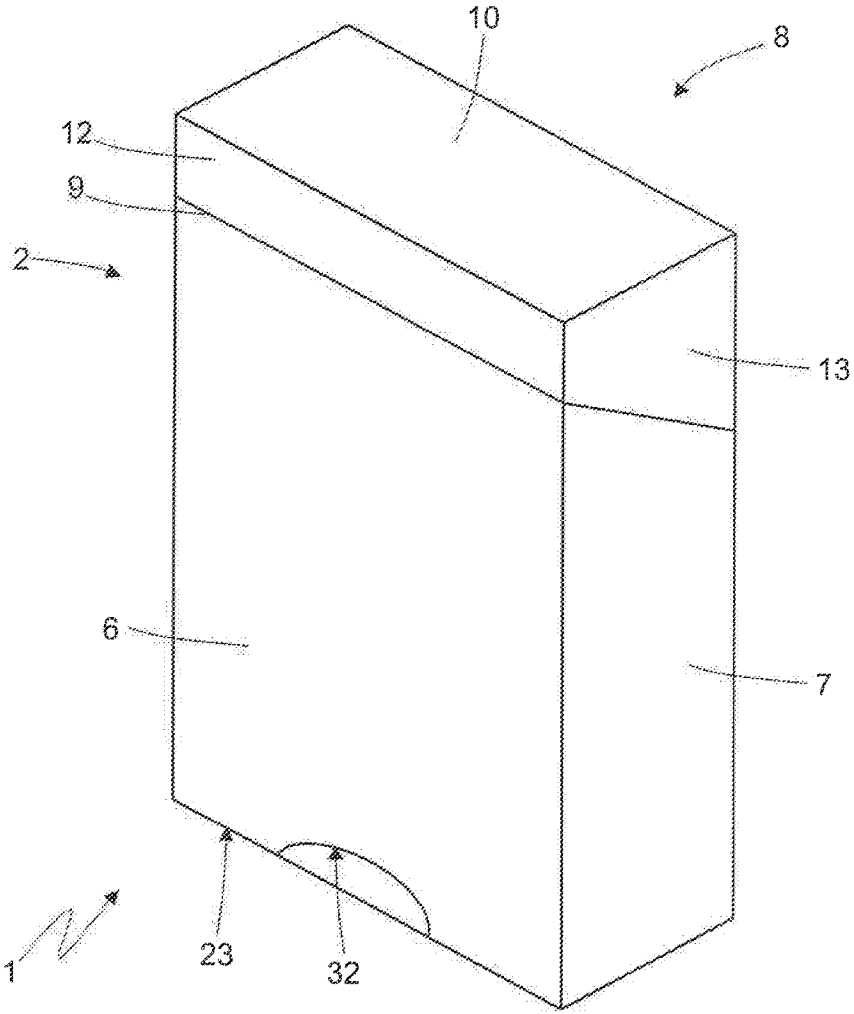
FIG. 12 is a rear perspective view of the pack of electrically heated cigarettes of FIG. 11 in a closed configuration.
Figure 11:
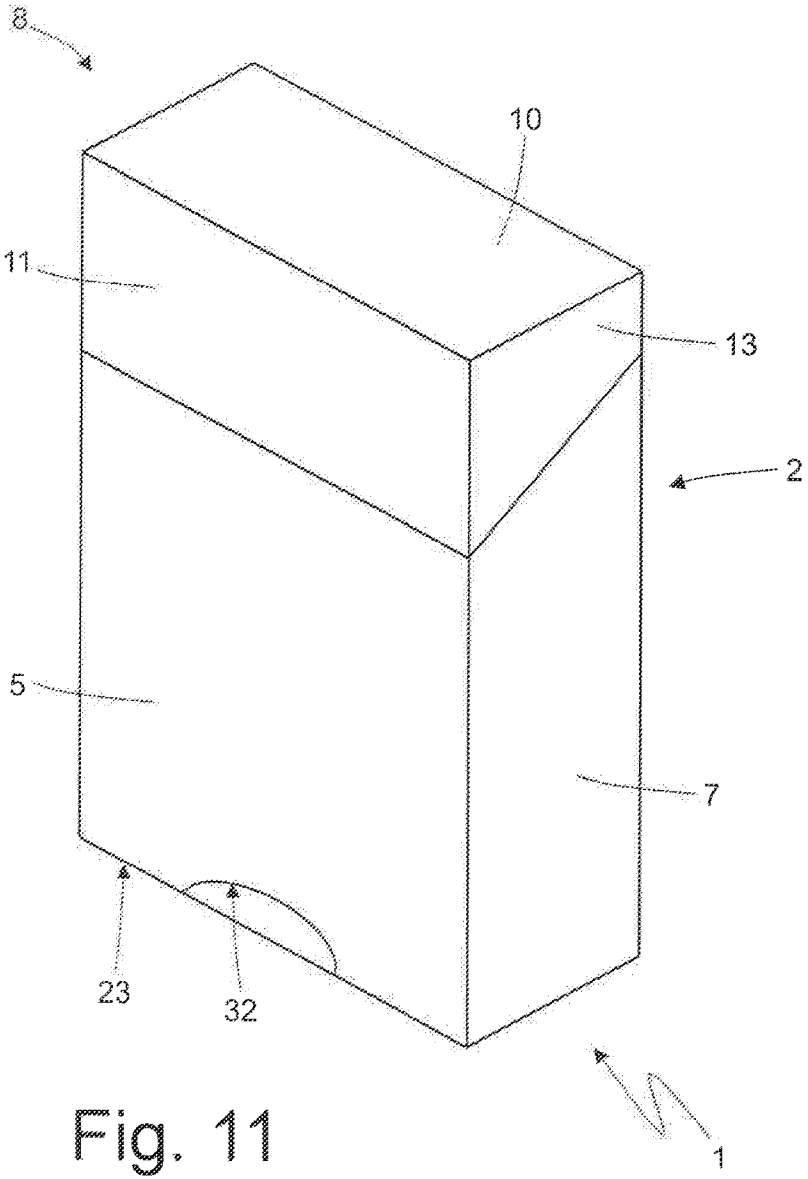
FIG. 11 is a front perspective view of a different embodiment of a pack of electrically heated cigarettes which is made according to the present invention and is in a closed configuration.

As illustrated in FIG. 13, a side wall 28 of the drawer 23 has a circular-shaped access opening 47 (obviously any other type of shape other than the circular shape could be possible) through which it is possible to access (in particular to insert objects) inside the drawer 23; according to alternative embodiments not illustrated, the access opening 47 is formed in the front wall 26 or in the rear wall 27 of the drawer 23 (it is also possible to have several access openings 47 in different walls of the drawer 23). It is important to note that in the embodiment illustrated in FIGS. 11-13, the access opening 47 is accessible (therefore visible) only when the drawer 23 is extracted (as illustrated in FIG. 13) and is not accessible (therefore visible) when the drawer 23 is closed (as illustrated in FIGS. 11 and 12). In the embodiment illustrated in FIGS. 11, 12, 13, 13*a*, holding recesses 32 are formed in the area of the front wall 5 and of the rear wall 6 of the container 2 instead of being formed in the area of the side walls 7 of the container 2 as shown in the embodiment illustrated in FIGS. 1-5.

In the embodiment illustrated in FIGS. 11, 12, 13, 13*a*, the two stopping tabs 31 of the limit stop device 29 are respectively connected to the top edge of the front wall 26 of the drawer 23 and to the top edge of the rear wall 27 of the drawer 23; similarly, the two stopping tabs 30 of the limit stop device 29 are respectively connected to the bottom edge of the front wall 5 of the container 2 and to the bottom edge of the rear wall 6 of the container 2.

In the embodiment illustrated in FIGS. 11, 12, 13, 13*a*, the drawer 23 is completely without the top wall; according to an alternative not illustrated, the drawer 23 could also comprise the top wall which could also completely close the drawer 23 as the drawer 23 is laterally accessible through the access opening 47 and must not be accessible from above.

In any case, the top chamber 17 and the bottom chamber 18 are spaced apart from one another by a dividing wall 19. Again in this case, the dividing wall 19 could be made in a manner similar to that described with reference to the pack 1 of electrically heated cigarettes illustrated in FIGS. 1-5.

Figure 14:
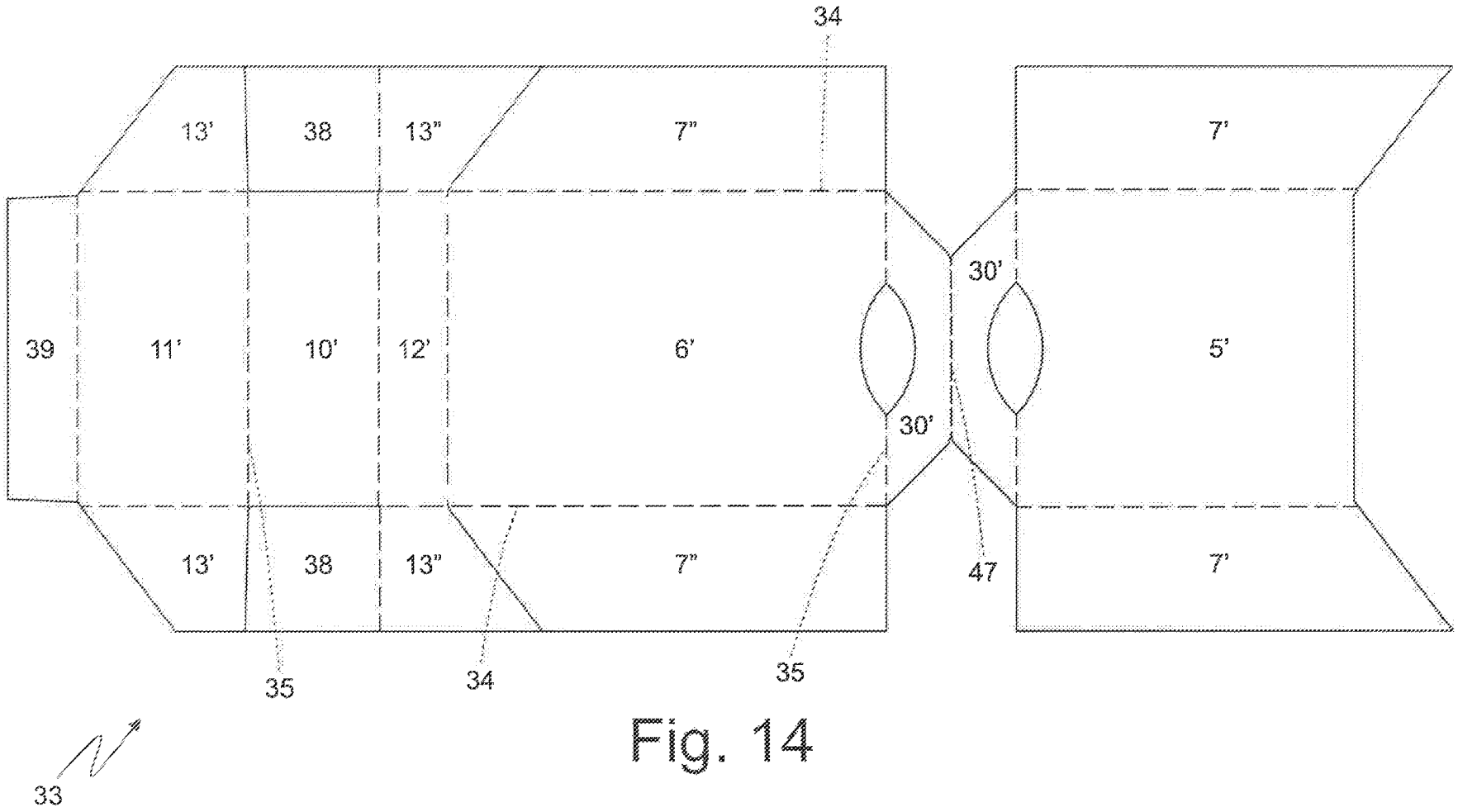
FIG. 14 is a plan view of a blank used to make a container and a lid of the pack of electrically heated cigarettes of FIG. 11.

As illustrated in FIG. 14, the container 2 and the lid 8 of the pack 1 of electrically heated cigarettes illustrated in FIGS. 11, 12,13, 13*a* are obtained starting from a flat blank 33 similar to the flat blank 33 illustrated in FIG. 7. The differences between the blank 33 illustrated in FIG. 7 and the blank 33 illustrated in FIG. 14 are in the different positioning of the wings 30' making up the stopping tabs 30 of the limit stop device 29 and in the absence, in the blank 33 illustrated in FIG. 14, of the panel 4' making up the bottom wall 4 of the container 2. In particular, in the blank 33 illustrated in FIG. 14, the two panels 6' and 5' are initially connected, by a tearable line 47 which connects the two corresponding wings 30' and is torn during the folding of the blank 33 to separate the two wings 30'. In other words, in the blank 33 illustrated in FIG. 14, the panel 4' is replaced by the two wings 30' which are opposite to one another and are connected one another by the tearable line 47 which is torn during the folding of the blank 33 to separate the two wings 30' themselves.

Figure 15:
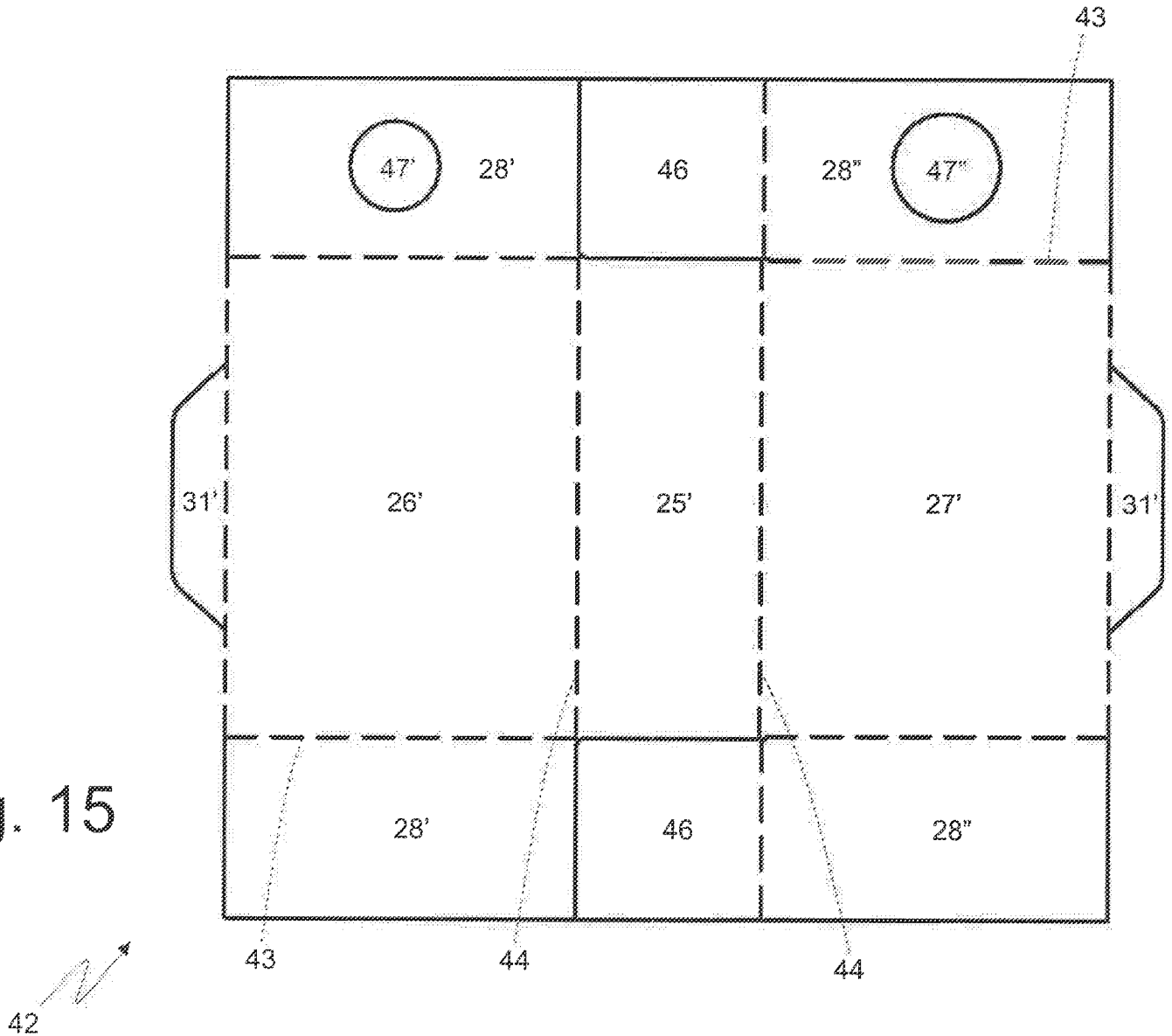
FIG. 15 is a plan view of a blank used to make a drawer of the pack of electrically heated cigarettes of FIG. 11.
Figure 17:
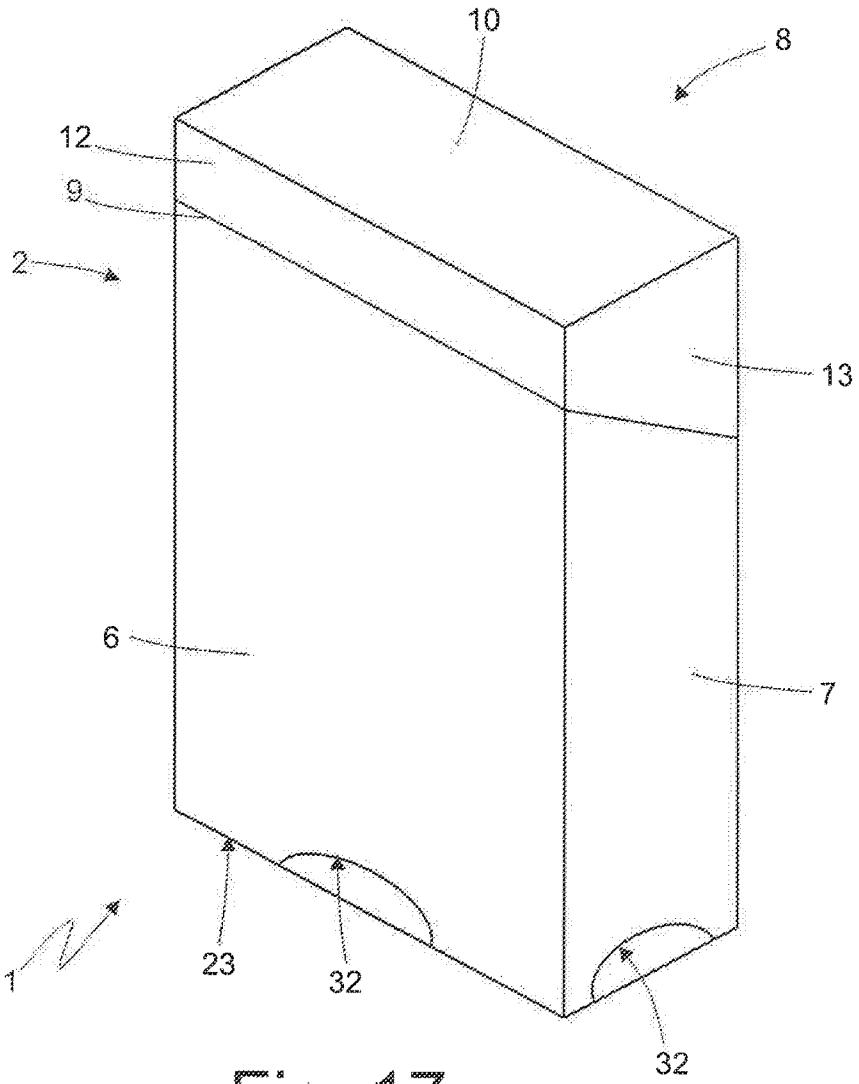
FIG. 17 is a rear perspective view of the pack of electrically heated cigarettes of FIG. 16 in a closed configuration.

As illustrated in FIG. 15, the drawer 23 of the pack 1 of electrically heated cigarettes illustrated in FIGS. 11-13 is obtained starting from a flat blank 42 similar to the flat blank 42 illustrated in FIG. 9. The differences between the blank 42 illustrated in FIG. 9 and the blank 42 illustrated in FIG. 15 are in the different positioning of the wings 31' making up the stopping tabs 31 of the limit stop device 29, in the absence, in the blank 42 illustrated in FIG. 15, of the panels 45' and 45" making up the top wall of the drawer 23, and in the presence, in the blank 42 illustrated in FIG. 15, of the holes 47' and 47" which are overlapping one another to make up the access opening 47. Preferably, the hole 47" formed in the wing 28" (which makes up an inner part of a side wall 28 of the drawer 23) has a slightly larger diameter than the hole 47' formed in the wing 28' (which makes up an outer part of a side wall 28 of the drawer 23) so as to prevent any misalignments between the two holes 47' and 47" from being noted from the outside.

Figure 16:
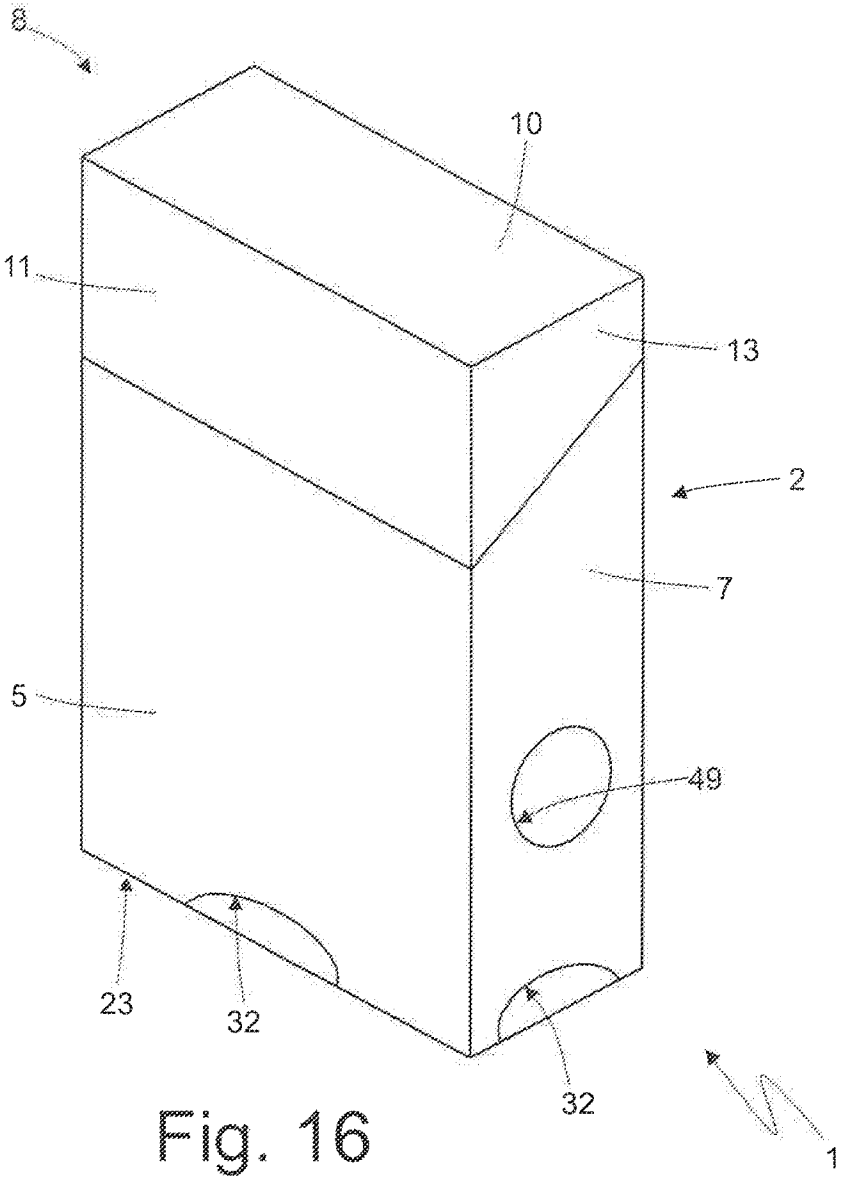
FIG. 16 is a front perspective view of an alternative of the pack of cigarettes of FIG. 11 in a closed configuration.
Figure 18:
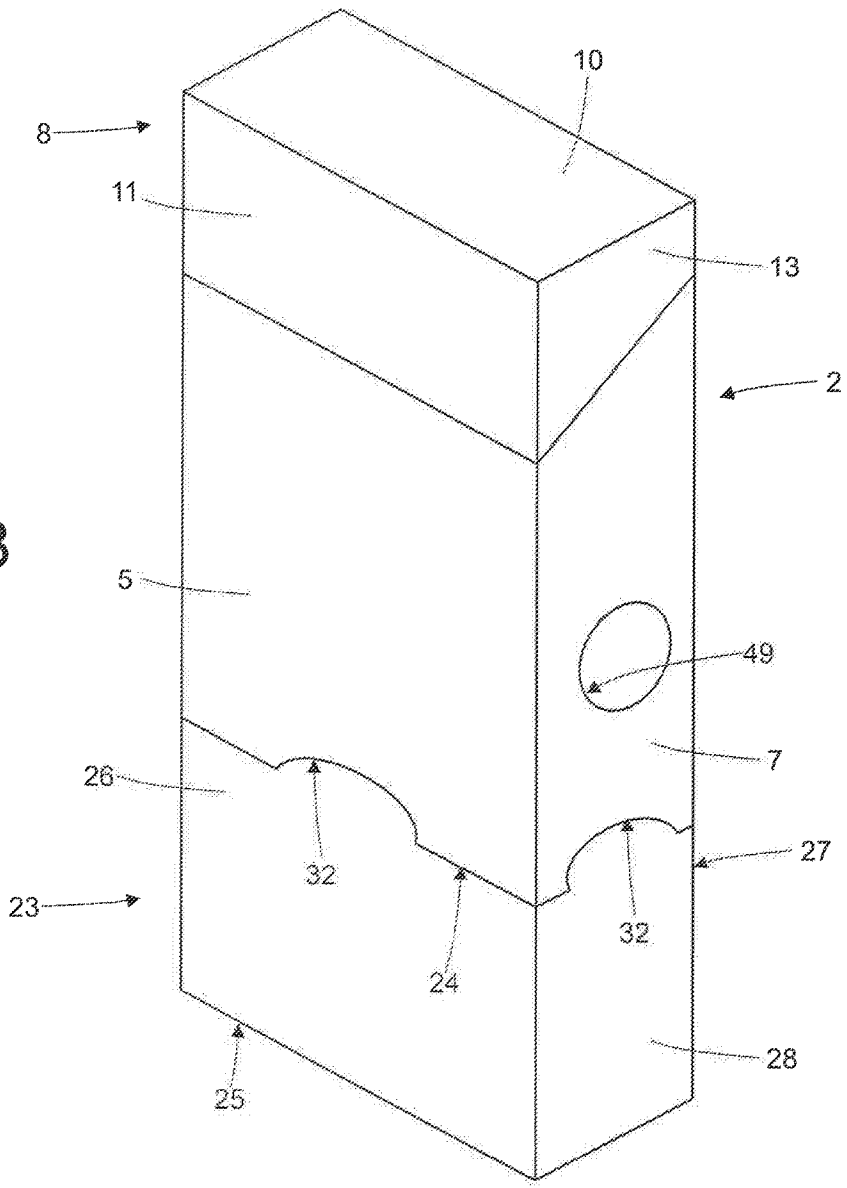
FIG. 18 is a front perspective view of the pack of electrically heated cigarettes of FIG. 16 in a configuration open from the bottom.

FIGS. 16-19 illustrate an alternative of the pack 1 of electrically heated cigarettes illustrated in FIGS. 11-13, which differs from the pack 1 of electrically heated cigarettes in FIGS. 11, 12, 13, 13*a* only for two details: holding recesses 32 are formed both in the area of the front wall 5 and of the rear wall 6 of the container 2, and in the area of the side walls 7 of the container 2 (namely four holding recesses 32 are provided instead of only two holding recesses 32 as in the other embodiments), and the access opening 49 formed in a side wall 28 of the drawer 23 is replaced by a similar access opening 49 formed in a side wall 7 of the container 2. In particular, the access opening 49 is always visible even when the drawer 23 is in the closed position (as illustrated in FIG. 16) but when the drawer 23 is in the closed position it is internally stopped by a corresponding side wall 28 of the drawer 23 and therefore becomes usable only when the drawer 23 is in the open position (as illustrated in FIG. 18).

Figure 19:
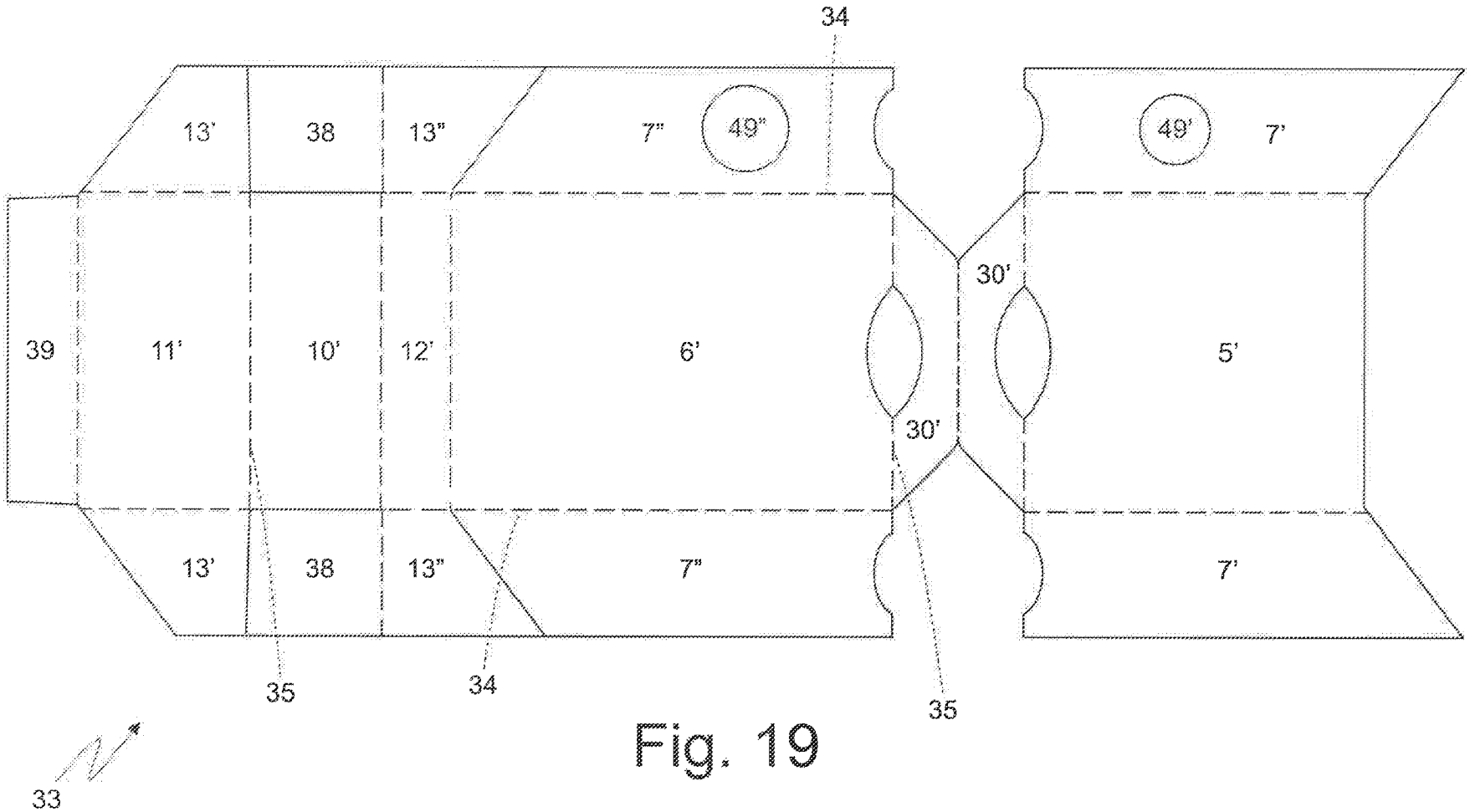
FIG. 19 is a plan view of a blank used to make a container and a lid of the pack of electrically heated cigarettes of FIG. 16.

As illustrated in FIG. 19, the container 2 and the lid 8 of the pack 1 of electrically heated cigarettes illustrated in FIGS. 16-19 are obtained starting from a flat blank 33 which is almost identical to the flat blank 33 illustrated in FIG. 14, from which it differs only for the presence of the holding recesses 32 also in the wings 7' and 7" and in the presence of the holes 49' and 49" which are superimposed one another to make up an access opening 49. Preferably, the hole 49" formed in the wing 7" (which makes up an inner part of a side wall 7 of the container 2) has a slightly larger diameter than the hole 49' formed in the wing 7' (which makes up an outer part of a side wall 7 of the container 2) so as to prevent any misalignments between the two holes 49' and 49" from being noted from the outside.

Figure 20:
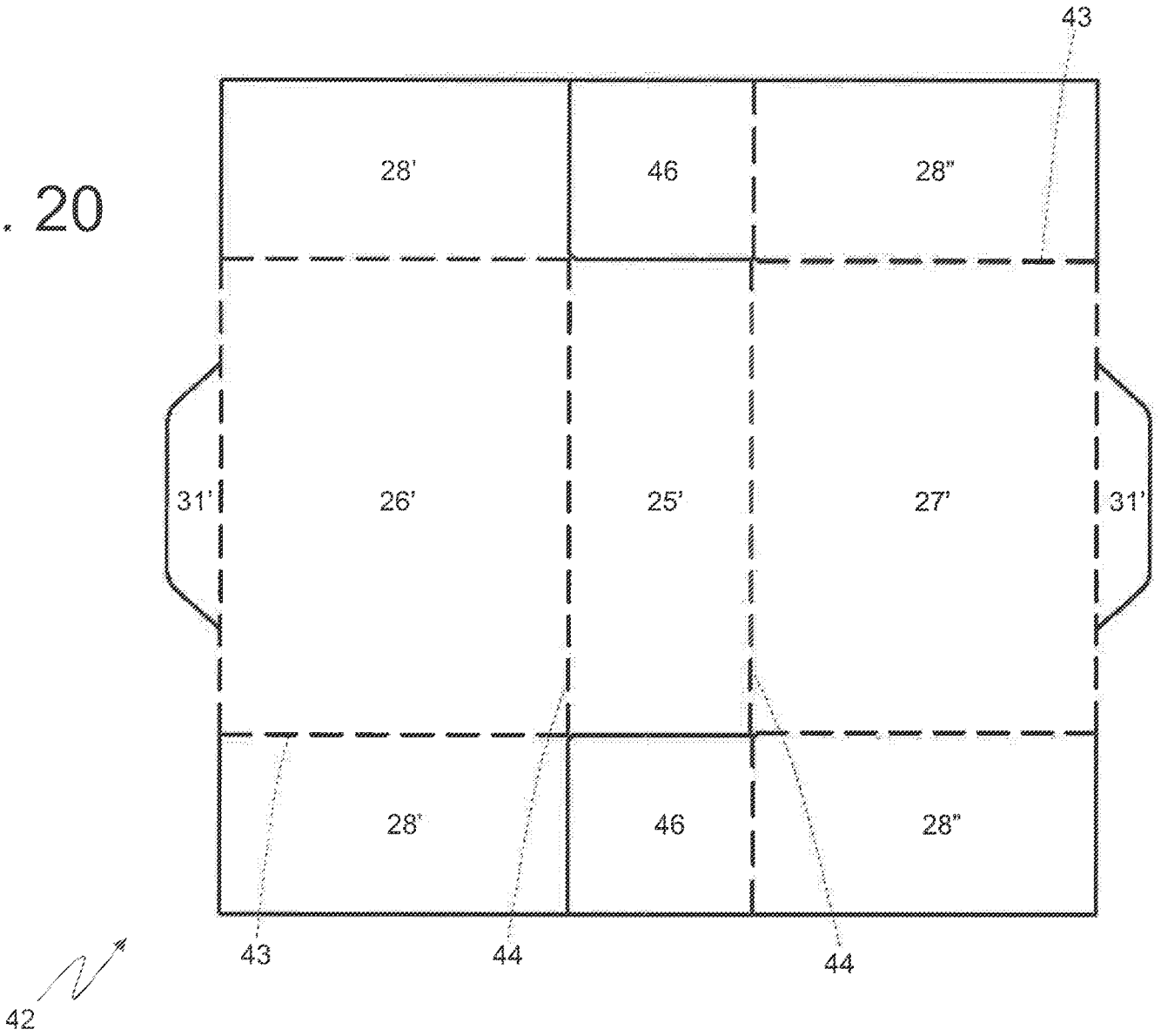
FIG. 20 is a plan view of a blank used to make a drawer of the pack of electrically heated cigarettes of FIG. 16.

As illustrated in FIG. 20, the drawer 23 of the pack 1 of electrically heated cigarettes illustrated in FIGS. 11-13 is obtained staring from a flat blank 42 which is almost identical to the flat blank 42 illustrated in FIG. 15, from which it differs only in the absence of the holes 47' and 47" which are overlapping one another to make up an access opening 47.

In the embodiments illustrated in the attached figures, the longitudinal and transverse edges are straight; alternatively, the longitudinal and/or transverse edges may be rounded or bevelled.

The pack 1 of electrically heated cigarettes above described has many advantages.

First, the pack 1 of cigarettes described above, although housing electrically heated cigarettes, that are considerably shorter than traditional cigarettes, has a totally similar size to the size of a traditional pack of cigarettes; in this way, the handling (in particular the extraction of the electrically heated cigarettes) of the pack 1 of electrically heated cigarettes described above is easy and immediate for all users.

In addition, in the pack 1 of electrically heated cigarettes described above, the space not used by the group of electrically heated cigarettes, namely the bottom chamber 18, is not useless (i.e. wasted) but is exploited as a usable container to house an accessory or to house the cigarettes already used and therefore exhausted. In particular, the access to the bottom chamber 18 is very simple and convenient thanks to the presence of the drawer 23 which can be easily opened and closed when needed.

The presence of drawer 23 that needs to be extracted so as to insert/pick up something also ensures that what is housed in drawer 23 does not fall out unintentionally e.g. when pack 1 pack of electrically heated cigarettes is contained in the pocket of a suit or in a purse.

Therefore, the presence of drawer 23 involves both practical and functional advantages and improvements in consumer perception (accustomed to the size of traditional packs of cigarettes) with respect to packs of electrically heated cigarettes of known art.

In particular, the distance between the bottom wall 25 of the drawer 23 when the latter is in its closed position, and the top wall 10 of the lid 8 when the latter closes the top opening of the container 2 is comprised between 8 centimetres and 10 centimetres. In other words, the height of pack 1 object of the present invention is comprised between 8 centimetres and 10 centimetres.

In particular, the distance between the side walls 7 of the container 2 (namely, the width of pack 1) is comprised between 5.0 centimetres and 5.7 centimetres (preferably 5.3 centimetres).

For example, the distance between the front wall 6 and the rear wall 8 of the container 2 (namely, the depth of pack 1 is comprised between 1.8 centimetres and 2.3 centimetres (preferably 2.1 centimetres).

In the foregoing description, the top chamber 17 and the bottom chamber 18 have approximately the same volume (namely, the two chambers 17 and 18 substantially divide the total volume in half). In this way, the bottom chamber 18 is able to contain almost all the electrically heated cigarettes housed in the top chamber 17 when the electrically heated cigarettes are exhausted; in other words, the fact that the bottom chamber 18 has approximately the same volume as the top chamber 17 is intended to provide a specific technical effect, namely allow the bottom chamber 18 to also house almost all the electrically heated cigarettes previously housed in the top chamber 17, once the electrically heated cigarettes are exhausted.

Finally, the pack 1 of electrically heated cigarettes described above can easily be produced in a standard packing machine (which only needs a few changes of modest entity) and therefore the production thereof does not require the use of an expensive special packing machine (i.e. specially designed for this type of packs of electrically heated cigarettes). This result is achieved by the fact that the blanks are completely similar to the corresponding traditional blanks and in that the drawer 23 can be assembled in advance and coupled to the blank 33 together with the wrap 3 or the wraps 3*a*, 3*b*, (for example by exploiting the existing spaces for feeding coupons to feed the drawers 23 which are arranged beside the wraps 3 (3*a*, 3*b*) to form wrapping units/drawer 23 which are successively laid on the wrap 33).

It is important to point out that the pack 1 of electrically heated cigarettes described above can advantageously be used to house tobacco articles of reduced height such as refill cartridges for electronic cigarettes, which have about the same size as the electrically heated cigarettes.

The invention claimed is:

1. A pack (1) of electrically heated cigarettes comprising:

a group of electrically heated cigarettes;

a container (2), which houses the group of cigarettes and comprises a top opening, a front wall (6), a rear wall (8) opposite the front wall (6), and two side walls (7) opposite one another, wherein the container (2) comprises a top chamber (17), which houses the group of cigarettes, a bottom chamber (18) and a dividing wall (19) that divides the top chamber (17) from the bottom chamber (18);

a lid (8), which comprises: a top wall (10), a front wall (11), a rear wall (12) opposite the front wall (11) and connected to the rear wall (6) of the container (2), and two side walls (13) opposite one another;

a drawer (23), which is arranged in the area of the bottom chamber (18) and can slide between a closed position, in which the drawer (23) is completely arranged inside the container (2), and an open position, in which the drawer (23) is partially pulled out of the container (2), projects outwards from the container (2) and is accessible from the outside; and a limit stop device (29), which fulfils the function of stopping the outward movement of the drawer (23) from the container (2) to prevent the drawer (23) from being completely pulled out of the container (2), thus establishing a maximum limit for the outward movement of the drawer (23) from the container (2); and wherein:

the drawer (23) comprises: a bottom wall (25), a front wall (26), a rear wall (27) opposite the front wall (26) and two side walls (28) opposite one another;

the distance between the dividing wall (10) and the top wall (10) of the lid (8), when the lid closes the top opening of the container (2), is comprised between 4.5 and 5.5 centimetres;

the distance between the bottom wall (25) of the drawer (23), when the drawer is in its closed position, and the dividing wall (19) is comprised between 3.5 centimetres and 4.5 centimetres;

the top chamber (17) is divided into two semi-chambers, side by side, each housing a corresponding semi-group of electrically heated cigarettes;

each semi-group of electrically heated cigarettes is wrapped in a wrap;

a label is fixed to the wrap;

the wrap has an extraction mouth that can be opened and closed by means of the label; and said label is fixed to the wrap by means of a repositionable adhesive, which is arranged around the extraction mouth to allow the label to be partially separated from the wrap several times for opening the extraction mouth and then fixed again to the wrap for closing the extraction mouth.

2. The pack (1) of electrically heated cigarettes according to claim 1, wherein the distance between the side walls (7) of the container (2) is comprised between 5.0 centimetres and 5.7 centimetres.

3. The pack (1) of electrically heated cigarettes according to claim 1, wherein the distance between the front wall (6) and the rear wall (8) of the container (2) is comprised between 1.8 centimetres and 2.3 centimetres.

4. The pack (1) of electrically heated cigarettes according to claim 1, wherein a tab (54) of the label (53) is glued to the front wall (11) of lid (8) so that the label (53) is opened and closed by exploiting the movement of the lid (8).

5. The pack (1) of electrically heated cigarettes according to claim 1, wherein the limit stop device (29) comprises:

two first stopping tabs (30), each of which is connected, in the area of an edge of a pull-out opening (24) through which the drawer (23) moves, to a wall (7; 5, 6) of the container (2) and projects towards the inside of the container (2); and two second stopping tabs (31), each of which is connected to a wall (28; 26, 27) of the drawer (23) and projects towards the outside of the drawer (23).

6. The pack (1) of electrically heated cigarettes according to claim 1 and comprising at least one rigid collar (14), which is folded in a U-shape, is arranged inside the container (2) so as to partially project outwards from the top end, and comprises: a front wall (15) and two side walls (16) opposite one another.

7. The pack (1) of electrically heated cigarettes according to claim 6, wherein:

the at least one rigid collar (14) forms said dividing wall (19), which is parallel to the top wall (10) of the lid (8);

the dividing wall (19) is connected to the front wall (15) of the at least one rigid collar (14) along a transverse folding line and is folded by 90° relative to the front wall (15) of the at least one rigid collar (14); and the dividing wall (19) is provided with a connection tab (20), which is connected to the dividing wall (19) along a transverse folding line, is folded by 90° relative to the dividing wall (19) and rests against as well as is glued to the rear wall (6) of the container (2).

8. The pack (1) of electrically heated cigarettes according to claim 1, wherein:

the container (2) comprises a bottom wall (4) opposite the top opening;

the drawer (23) moves transversely, with a moving direction that is parallel to the bottom wall (4) of the container (2) and to the top wall (10) of the lid (8) and perpendicular to the side walls (7) of the container (2) and to the side walls (13) of the lid (8); and a side wall (7) of the container (2) has a pull-out opening (24), through which the drawer (23) moves.

9. The pack (1) of electrically heated cigarettes according to claim 8, wherein:

the limit stop device (29) comprises: two first stopping tabs (30), each of which is connected, in the area of an edge of a pull-out opening (24), through which the drawer (23) moves, to a wall (7; 5, 6) of the container (2) and projects towards the inside of the container (2); and two second stopping tabs (31), each of which is connected to a wall (28; 26, 27) of the drawer (23) and projects towards the outside of the drawer (23); and the front wall (26) and the rear wall (27) of the drawer (23) carry the corresponding second stopping tabs (31) that are cut-out from the front and rear walls, respectively.

10. The pack (1) of electrically heated cigarettes according to claim 1, wherein:

the container (2) has a pull-out opening (24), which is opposite the top opening and through which the drawer (23) moves; and the drawer (23) moves longitudinally, with a moving direction that is perpendicular to the top wall (10) of the lid (8) and parallel to the side walls (7) of the container (2) and to the side walls (13) of the lid (8).

11. The pack (1) of electrically heated cigarettes according to claim 10, wherein:

the limit stop device (29) comprises: two first stopping tabs (30), each of which is connected, in the area of an edge of a pull-out opening (24), through which the drawer (23) moves, to a wall (7; 5, 6) of the container (2) and projects towards the inside of the container (2); and two second stopping tabs (31), each of which is connected to a wall (28; 26, 27) of the drawer (23) and projects towards the outside of the drawer (23);

the container (2) and the lid (8) are obtained by folding a blank (33) having a first panel (6'), which makes up the rear wall (6) of the container (2) and a second panel (5'), which makes up the front wall (5) of the container (2);

in the blank (33), between the fourth panel (6') and the fifth panel (5'), two wings (30') are interposed, which make up the two first stopping tabs (30) and are each connected to a corresponding panel (5', 6') along a transverse folding line (35); and the two wings (30') making up the two first stopping tabs (30) are connected, at first, by a tearable line (47), which is torn during the folding of the blank (33) in order to separate the two wings (30').

12. The pack (1) of electrically heated cigarettes according to claim 10, wherein a wall (28) of the drawer (23) has a first access opening (47), through which one can access the inside of the drawer (23).

13. The pack (1) of electrically heated cigarettes according to claim 10, wherein a wall (7) of the container has a second access opening (49), through which one can access the inside of the drawer (23).

14. The pack (1) of electrically heated cigarettes according to claim 1, wherein the drawer (23) comprises a top wall (45).

15. The pack (1) of electrically heated cigarettes according to claim 1, wherein at least two walls (5, 6, 7) of the container (2) comprise respective claw-shaped holding recesses (32), which allow a user to get hold of the underlying walls (26, 27, 28) of the drawer (23).

* * * * *